US011668101B2

(12) United States Patent
Cappelle

(10) Patent No.: US 11,668,101 B2
(45) Date of Patent: Jun. 6, 2023

(54) FLOOR PANEL

(71) Applicant: FLOORING INDUSTRIES LIMITED, SARL, Bertrange (LU)

(72) Inventor: Mark Cappelle, Staden (BE)

(73) Assignee: FLOORING INDUSTRIES LIMITED, SARL, Bertrange (LU)

( * ) Notice: Subject to any disclaimer, the term of this patent is extended or adjusted under 35 U.S.C. 154(b) by 1 day.

(21) Appl. No.: 17/220,141

(22) Filed: Apr. 1, 2021

(65) Prior Publication Data

US 2021/0214955 A1 Jul. 15, 2021

Related U.S. Application Data

(63) Continuation of application No. 16/989,464, filed on Aug. 10, 2020, now Pat. No. 10,995,500, which is a
(Continued)

(30) Foreign Application Priority Data

Nov. 23, 2007 (BE) ..... 2007/0567
Jun. 26, 2008 (DE) ..... 202008008597

(51) Int. Cl.
*E04B 2/00* (2006.01)
*E04F 15/02* (2006.01)
(Continued)

(52) U.S. Cl.
CPC ..... *E04F 15/02038* (2013.01); *E04F 15/02* (2013.01); *E04F 15/045* (2013.01);
(Continued)

(58) Field of Classification Search
CPC ..... E04F 15/02038; E04F 2201/023; E04F 2201/043; E04F 2201/044;
(Continued)

(56) References Cited

U.S. PATENT DOCUMENTS 4,037,377 A * 7/1977 Howell ..... E04C 2/296 52/592.1
5,274,979 A * 1/1994 Tsai ..... E04F 13/0878 52/610
(Continued)

FOREIGN PATENT DOCUMENTS

CA 991373 A 6/1976
DE 20008708 U1 9/2000
(Continued)

OTHER PUBLICATIONS

International Search Report and Written Opinion from PCT Application No. PCT/IB2010/050153, dated Jan. 5, 2011.
(Continued)

*Primary Examiner* — Brian E Glessner
*Assistant Examiner* — James J Buckle, Jr.
(74) *Attorney, Agent, or Firm* — Workman Nydegger

(57) ABSTRACT

Floor panel, with a horizontally and vertically active locking system allowing that two of such floor panels can be connected to each other at said sides by providing one of these floor panels, by means of a downward movement, in the other floor panel; wherein the vertically active locking system comprises a locking element in the form of an insert; wherein this locking element comprises at least a pivotable lock-up body; characterized in that the pivotable lock-up body comprises a support portion which is rotatable against a support surface pertaining to the floor panel concerned, and more particularly in a seat.

16 Claims, 17 Drawing Sheets

Related U.S. Application Data continuation of application No. 15/941,594, filed on Mar. 30, 2018, now Pat. No. 10,815,674, which is a continuation of application No. 15/160,240, filed on May 20, 2016, now abandoned, which is a continuation of application No. 14/626,444, filed on Feb. 19, 2015, now Pat. No. 9,371,654, which is a continuation of application No. 14/104,685, filed on Dec. 12, 2013, now Pat. No. 8,966,852, which is a continuation of application No. 12/744,231, filed as application No. PCT/IB2008/003133 on Nov. 19, 2008, now Pat. No. 8,621,814.

(60) Provisional application No. 61/071,201, filed on Apr. 17, 2008.

(51) Int. Cl.
*E04F 15/04* (2006.01)
*E04F 15/10* (2006.01)

(52) U.S. Cl.
CPC ..... *E04F 15/10* (2013.01); *E04F 15/107* (2013.01); *E04F 15/04* (2013.01); *E04F 2201/0115* (2013.01); *E04F 2201/0138* (2013.01); *E04F 2201/0146* (2013.01); *E04F 2201/0153* (2013.01); *E04F 2201/0176* (2013.01); *E04F 2201/023* (2013.01); *E04F 2201/043* (2013.01); *E04F 2201/044* (2013.01); *E04F 2201/049* (2013.01); *E04F 2201/0523* (2013.01); *E04F 2201/0552* (2013.01); *E04F 2201/0588* (2013.01)

(58) Field of Classification Search
CPC ..... E04F 2201/049; E04F 2201/0115; E04F 2201/0146; E04F 2201/0138; E04F 2201/0153; E04F 2201/0176; E04F 2201/0523; E04F 2201/0552; E04F 2201/0588
USPC ..... 52/309.1, 309.13, 582.1, 582.2, 586.1, 52/586.2, 591.1, 592.1, 588.1; 403/309, 403/364
See application file for complete search history.

(56) References Cited

U.S. PATENT DOCUMENTS 5,437,934 A * 8/1995 Witt ..... B32B 27/30 428/537.1
6,006,486 A 12/1999 Moriau et al.
6,101,778 A 8/2000 Martensson
6,421,970 B1 7/2002 Martensson et al.
6,490,836 B1 12/2002 Moriau et al.
6,647,690 B1 11/2003 Martensson
6,769,835 B2 8/2004 Stridsman
6,854,235 B2 2/2005 Martensson
6,874,292 B2 4/2005 Moriau et al.
6,928,779 B2 8/2005 Moriau et al.
6,955,020 B2 10/2005 Moriau et al.
6,993,877 B2 2/2006 Moriau et al.
7,040,068 B2 5/2006 Moriau et al.
7,131,242 B2 11/2006 Martensson et al.
7,328,536 B2 2/2008 Moriau et al.
7,365,494 B2 4/2008 Sato
7,451,578 B2 11/2008 Hannig
7,467,499 B2 12/2008 Moriau et al.
7,484,337 B2 2/2009 Hecht
7,603,826 B1 10/2009 Moebus
7,617,645 B2 11/2009 Moriau et al.
7,621,092 B2 11/2009 Groeke et al.
7,621,094 B2 11/2009 Moriau et al.
7,634,884 B2 12/2009 Pervan et al.
7,634,886 B2 12/2009 Moriau et al.
7,634,887 B2 12/2009 Moriau et al.
7,637,066 B2 12/2009 Moriau et al.
7,637,067 B2 12/2009 Moriau et al.
7,637,068 B2 12/2009 Pervan
7,640,708 B2 1/2010 Moriau et al.
7,644,554 B2 1/2010 Moriau et al.
7,644,555 B2 1/2010 Moriau et al.
7,644,557 B2 1/2010 Moriau et al.
7,647,741 B2 1/2010 Moriau et al.
7,647,743 B2 1/2010 Moriau et al.
7,650,727 B2 1/2010 Moriau et al.
7,650,728 B2 1/2010 Moriau et al.
7,654,054 B2 2/2010 Moriau et al.
7,658,048 B2 2/2010 Moriau et al.
7,661,238 B2 2/2010 Moriau et al.
7,665,265 B2 2/2010 Moriau et al.
7,665,266 B2 2/2010 Moriau et al.
7,665,267 B2 2/2010 Moriau et al.
7,665,268 B2 2/2010 Moriau et al.
7,669,376 B2 3/2010 Moriau et al.
7,669,377 B2 3/2010 Moriau et al.
7,673,431 B2 3/2010 Moriau et al.
7,677,008 B2 3/2010 Moriau et al.
7,681,371 B2 3/2010 Moriau et al.
7,698,868 B2 4/2010 Moriau et al.
7,698,869 B2 4/2010 Moriau et al.
7,707,793 B2 5/2010 Moriau et al.
7,712,280 B2 5/2010 Moriau et al.
7,726,088 B2 6/2010 Muehlebach
7,726,089 B2 6/2010 Moriau et al.
7,735,288 B2 6/2010 Moriau et al.
7,757,453 B2 7/2010 Moriau et al.
7,762,035 B2 7/2010 Cappelle
7,770,350 B2 8/2010 Moriau et al.
7,810,297 B2 10/2010 Moriau et al.
7,827,754 B2 11/2010 Moriau et al.
7,827,755 B2 11/2010 Moriau et al.
7,841,144 B2 11/2010 Pervan
7,841,145 B2 11/2010 Pervan et al.
7,866,110 B2 1/2011 Pervan
7,980,039 B2 7/2011 Groeke et al.
7,980,043 B2 7/2011 Moebus
8,024,904 B2 9/2011 Hannig
8,029,880 B2 10/2011 Liu
8,042,311 B2 10/2011 Pervan et al.
8,079,196 B2 12/2011 Pervan
8,091,238 B2 1/2012 Hannig
8,132,384 B2 3/2012 Hannig
8,166,723 B2 5/2012 Moriau et al.
8,323,016 B2 * 12/2012 Jacobsson ..... B29C 33/60 425/374
8,341,915 B2 1/2013 Pervan et al.
8,365,494 B2 2/2013 Moriau et al.
8,381,477 B2 2/2013 Pervan et al.
8,387,327 B2 3/2013 Pervan
8,516,767 B2 8/2013 Engstrom
8,591,691 B2 * 11/2013 Wallin ..... E04F 15/04 156/268
8,621,814 B2 1/2014 Cappelle
8,631,621 B2 1/2014 Hannig
8,677,714 B2 3/2014 Pervan
8,850,769 B2 10/2014 Pervan
8,966,852 B2 3/2015 Cappelle
8,966,853 B2 3/2015 Hannig
9,169,658 B2 10/2015 Hecht
9,314,936 B2 4/2016 Pervan
9,371,654 B2 6/2016 Cappelle
10,190,323 B2 * 1/2019 Meersseman ..... E04F 13/0894
2003/0024200 A1 2/2003 Moriau et al.
2003/0024201 A1 2/2003 Moriau et al.
2003/0029115 A1 2/2003 Moriau et al.
2003/0029116 A1 2/2003 Moriau et al.
2003/0029117 A1 2/2003 Moriau et al.
2003/0180091 A1 9/2003 Stridsman
2004/0068954 A1 4/2004 Martensson
2004/0128934 A1 7/2004 Hecht
2004/0182036 A1 * 9/2004 Sjoberg ..... E04F 15/02016 52/592.1

(56) References Cited

U.S. PATENT DOCUMENTS

| | | | | |
|---|---|---|---|---|
| 2004/0211143 | A1 | 10/2004 | Hanning | |
| 2005/0050827 | A1* | 3/2005 | Schitter | E04F 15/02 52/578 |
| 2005/0160694 | A1 | 7/2005 | Pervan | |
| 2005/0284075 | A1 | 12/2005 | Moriau et al. | |
| 2005/0284076 | A1 | 12/2005 | Moriau et al. | |
| 2006/0005499 | A1 | 1/2006 | Moriau et al. | |
| 2006/0025370 | A1 | 2/2006 | Trask et al. | |
| 2006/0032177 | A1 | 2/2006 | Moriau et al. | |
| 2006/0064940 | A1 | 3/2006 | Cappelle | |
| 2006/0196138 | A1 | 9/2006 | Moriau et al. | |
| 2006/0201095 | A1 | 9/2006 | Moriau et al. | |
| 2006/0225370 | A1 | 10/2006 | Moriau et al. | |
| 2006/0225377 | A1 | 10/2006 | Moriau et al. | |
| 2006/0236630 | A1 | 10/2006 | Moriau et al. | |
| 2006/0236631 | A1 | 10/2006 | Moriau et al. | |
| 2006/0236632 | A1 | 10/2006 | Moriau et al. | |
| 2006/0236633 | A1 | 10/2006 | Moriau et al. | |
| 2006/0236634 | A1 | 10/2006 | Moriau et al. | |
| 2006/0236635 | A1 | 10/2006 | Moriau et al. | |
| 2006/0236636 | A1 | 10/2006 | Moriau et al. | |
| 2006/0236637 | A1 | 10/2006 | Moriau et al. | |
| 2006/0236638 | A1 | 10/2006 | Moriau et al. | |
| 2006/0236642 | A1 | 10/2006 | Pervan | |
| 2006/0236643 | A1 | 10/2006 | Moriau et al. | |
| 2006/0248829 | A1 | 11/2006 | Moriau et al. | |
| 2006/0248830 | A1 | 11/2006 | Gustaaf et al. | |
| 2006/0248831 | A1 | 11/2006 | Moriau et al. | |
| 2006/0254183 | A1 | 11/2006 | Moriau et al. | |
| 2006/0254184 | A1 | 11/2006 | Moriau et al. | |
| 2006/0254185 | A1 | 11/2006 | Moriau et al. | |
| 2006/0260249 | A1 | 11/2006 | Moriau et al. | |
| 2006/0272263 | A1 | 12/2006 | Moriau et al. | |
| 2007/0006543 | A1 | 1/2007 | Engstrom | |
| 2007/0028547 | A1 | 2/2007 | Grafenauer et al. | |
| 2007/0094986 | A1 | 5/2007 | Moriau et al. | |
| 2007/0094987 | A1 | 5/2007 | Moriau et al. | |
| 2007/0107360 | A1 | 5/2007 | Moriau et al. | |
| 2007/0107363 | A1 | 5/2007 | Moriau et al. | |
| 2007/0193178 | A1 | 8/2007 | Groeke et al. | |
| 2007/0251188 | A1 | 11/2007 | Moriau et al. | |
| 2008/0010928 | A1 | 1/2008 | Moriau et al. | |
| 2008/0010929 | A1 | 1/2008 | Moriau et al. | |
| 2008/0010938 | A1 | 1/2008 | Hannig | |
| 2008/0034708 | A1 | 2/2008 | Pervan | |
| 2008/0053027 | A1 | 3/2008 | Moriau et al. | |
| 2008/0053028 | A1 | 3/2008 | Moriau et al. | |
| 2008/0060309 | A1 | 3/2008 | Moriau et al. | |
| 2008/0060310 | A1 | 3/2008 | Moriau et al. | |
| 2008/0060311 | A1 | 3/2008 | Moriau et al. | |
| 2008/0066415 | A1 | 3/2008 | Pervan et al. | |
| 2008/0066416 | A1 | 3/2008 | Moriau et al. | |
| 2008/0134607 | A1 | 6/2008 | Pervan et al. | |
| 2008/0134613 | A1 | 6/2008 | Pervan | |
| 2008/0134614 | A1 | 6/2008 | Pervan et al. | |
| 2008/0155930 | A1 | 7/2008 | Pervan et al. | |
| 2008/0236088 | A1 | 10/2008 | Hannig | |
| 2008/0295432 | A1 | 12/2008 | Pervan et al. | |
| 2009/0000232 | A1 | 1/2009 | Thiers et al. | |
| 2009/0019806 | A1 | 1/2009 | Muehlebach | |
| 2009/0133358 | A1 | 5/2009 | Hecht | |
| 2009/0193741 | A1 | 8/2009 | Cappelle | |
| 2009/0217615 | A1 | 9/2009 | Engstrom | |
| 2009/0249733 | A1 | 10/2009 | Moebus | |
| 2010/0043333 | A1 | 2/2010 | Hannig | |
| 2010/0281803 | A1 | 11/2010 | Cappelle | |
| 2010/0319292 | A1 | 12/2010 | Moriau et al. | |
| 2011/0023405 | A1 | 2/2011 | Moriau et al. | |
| 2011/0088345 | A1 | 4/2011 | Pervan | |
| 2011/0088346 | A1 | 4/2011 | Hannig | |
| 2011/0167750 | A1 | 7/2011 | Pervan | |
| 2011/0167751 | A1 | 7/2011 | Engstrom | |
| 2011/0271631 | A1 | 11/2011 | Engstrom | |
| 2011/0271632 | A1 | 11/2011 | Cappelle et al. | |
| 2012/0011796 | A1 | 1/2012 | Hannig | |
| 2012/0031029 | A1 | 2/2012 | Pervan et al. | |
| 2012/0036804 | A1 | 2/2012 | Pervan | |
| 2012/0042595 | A1 | 2/2012 | De Boe | |
| 2012/0055112 | A1 | 3/2012 | Engstrom | |
| 2012/0073235 | A1 | 3/2012 | Hannig | |
| 2012/0124932 | A1 | 5/2012 | Schulte et al. | |
| 2013/0081349 | A1 | 4/2013 | Pervan et al. | |
| 2013/0104487 | A1 | 5/2013 | Moriau et al. | |
| 2013/0145708 | A1 | 6/2013 | Pervan | |
| 2014/0033630 | A1 | 2/2014 | Engstrom | |
| 2014/0053497 | A1 | 2/2014 | Pervan et al. | |
| 2014/0150369 | A1 | 6/2014 | Hannig | |
| 2016/0215505 | A1 | 7/2016 | Cappelle et al. | |
| 2016/0265233 | A1 | 9/2016 | Cappelle | |

FOREIGN PATENT DOCUMENTS

| | | | |
|---|---|---|---|
| DE | 20112474 | U1 | 12/2002 |
| DE | 29924454 | U1 | 5/2003 |
| DE | 102004055951 | A1 | 7/2005 |
| DE | 102004001363 | A1 | 8/2005 |
| DE | 102005002297 | A1 | 8/2005 |
| DE | 202007000310 | U1 | 4/2007 |
| DE | 202008008597 | U1 | 8/2008 |
| EP | 1159497 | A1 | 12/2001 |
| EP | 1350904 | A2 | 10/2003 |
| EP | 1420125 | A2 | 5/2004 |
| EP | 1282752 | B1 | 10/2004 |
| EP | 1415056 | B1 | 1/2006 |
| EP | 1818478 | A1 | 8/2007 |
| JP | 07-300979 | A | 11/1995 |
| SE | 0515324 | | 7/2001 |
| SE | 515324 | C2 | 7/2001 |
| WO | 97/47834 | A1 | 12/1997 |
| WO | 2004/079130 | A1 | 9/2004 |
| WO | 2005/054599 | A1 | 6/2005 |
| WO | 2006/032398 | A1 | 3/2006 |
| WO | 2006/043893 | A1 | 4/2006 |
| WO | 2006/104436 | A1 | 10/2006 |
| WO | 2007/008139 | A1 | 1/2007 |
| WO | 2007/015669 | A2 | 2/2007 |
| WO | 2007/079845 | A1 | 7/2007 |
| WO | 2008/083662 | A1 | 7/2008 |
| WO | 2009/066153 | A2 | 5/2009 |

OTHER PUBLICATIONS

International Search Report and Written Opinion in PCT/IB2008/003133, dated Oct. 8, 2009.

Search Report of EPO/Belgium regarding Belgium Patent Application No. 2007/0567, dated Jul. 2, 2008.

* cited by examiner

FLOOR PANEL

CROSS REFERENCE SECTION

This invention is a continuation of application Ser. No. 16/989,464, filed Aug. 10, 2020, which is a continuation of application Ser. No. 15/941,594 filed Mar. 30, 2018, now U.S. Pat. No. 10,815,674, which is a continuation of application Ser. No. 15/160,240, filed May 20, 2016, now abandoned, which is a continuation of application Ser. No. 14/626,444, filed Feb. 19, 2015, now U.S. Pat. No. 9,371,654 which is a continuation of Ser. No. 14/104,685, filed Dec. 12, 2013, now U.S. Pat. No. 8,966,852, which is a continuation of application Ser. No. 12/744,231, filed May 21, 2010, now U.S. Pat. No. 8,621,814, which claims the benefit of U.S. provisional application No. 61/071,201, filed Apr. 17, 2008.

BACKGROUND OF THE INVENTION

Field of the Invention

This invention relates to a floor panel.

More particularly, it relates to a floor panel comprising coupling parts at least at two opposite sides, in the form of a male coupling part and a female coupling part, respectively, which allow to connect two of such floor panels to each other at the aforementioned sides by providing one of these floor panels with the pertaining male coupling part, by means of a downward movement, in the female coupling part of the other floor panel, such that thereby at least a locking in horizontal direction is obtained.

Related Art

Couplings allowing to couple two floor panels to each other by joining one floor panel with a downward movement into the other, in practice are subdivided into two kinds, namely a first kind wherein the coupling parts exclusively provide for a horizontal locking, without any presence of a locking in vertical direction, and a second kind wherein a horizontal as well as a vertical locking are provided for.

The couplings of the first kind are also known as so-called "drop-in" systems. Floor panels equipped with those at two opposite sides are known, amongst others, from CA 991.373 and JP 07-300979. As is evident from these patent documents, such "drop-in" systems often are only applied at a first pair of opposite sides of the floor panels, whereas then at the second pair of opposite sides, coupling parts are applied which, in the coupled condition of two floor panels, provide for a vertical as well as a horizontal locking and which allow that two of such floor panels can be coupled to each other by means of an angling movement. Floor panels with such a combination of coupling parts offer the advantage that they can be easily installed successively in rows, simply by coupling each new floor panel to be installed to the preceding row of floor panels by means of the angling movement and by providing for, when angling it down, that such floor panel simultaneously also engages in an already installed preceding floor panel of the same row. Thus, the installation of such floor panel only requires an angling and putting-down movement, which is a particularly user-friendly installation technique.

A disadvantage of floor panels with such coupling parts consists in that due to the fact that there is no locking in vertical direction, height differences between the coupled floor panels may arise at the top surface. Thus, for example, such floor panels in a first or last row of a floor covering may turn back upward from their flat position, if they are not held down by a skirting board or the like. Even if such floor panels are provided with a "drop-in" system at only one pair of sides, while being locked in horizontal as well as vertical directions at their other pair of sides in respect to adjacent floor panels, height differences may occur between adjacent floor panels at the sides coupled by the "drop-in" system, amongst others, when two adjacent floor panels are loaded differently, or when one floor panel should warp and bend somewhat in respect to the other.

Couplings of said second kind, also named "push-lock" systems, try to remedy the aforementioned disadvantage by also providing a vertical locking. Such so-called "push-lock" systems may be divided into two different categories, namely one-piece embodiments and embodiments comprising a separate locking element, which is made as an insert, whether or not fixedly attached to the actual floor panel.

One-piece embodiments are known, amongst others, from the patent documents DE 29924454, DE 20008708, DE 20112474, DE 102004001363, DE 102004055951, EP 1,282,752 and EP 1,350,904. The known one-piece embodiments have the disadvantage that they are working relatively stiff and a good joining of two floor panels can not always be guaranteed.

Embodiments comprising a separate locking element which assists in a vertical and possibly also horizontal locking between two coupled floor panels, are known, amongst others, from the patent documents DE 202007000310, DE 10200401363, DE 102005002297, EP 1,159,497, EP 1,415,056B1, EP 1,818,478, WO 2004/079130, WO 2005/054599, WO 2006/043893, WO 2006/104436, WO 2007/008139, WO 2007/079845 and SE 515324. The use of a separate locking element offers the advantage that the material thereof is independent of the actual floor panel and thus can be chosen in an optimum manner in function of the application. Thereby, such inserts may be made of synthetic material or metal, whereby relatively sturdy, however, still easily movable locking portions can be realized, which, with a minimum contact surface, can take up relatively large forces.

SUMMARY OF THE DISCLOSURE

The present invention relates to floor panels which are equipped with a "push-lock" system of the last-mentioned category, in other words, which comprise a whether or not fixedly attached, however, separately realized insert. The aim of the invention consists in a further optimization of these "push-lock" systems in floor panels. These improvements substantially consist of seven aspects, which will be discussed in the following.

The first five aspects are specifically connected to floor panels of the type:

which comprises, at least at two opposite sides, coupling parts with which two of such floor panels can be coupled to each other;

wherein these coupling parts form a horizontally active locking system and a vertically active locking system;

wherein the horizontally active locking system comprises a male part and a female part, which allow that two of such floor panels can be connected to each other at the aforementioned sides by providing one of these floor panels with the pertaining male part, by means of a downward movement, in the female part of the other floor panel;

wherein the vertically active locking system comprises a locking element, which is provided in the form of an insert in one of the sides concerned;

wherein this locking element comprises at least a pivotable lock-up body; and wherein the lock-up body, at one extremity, forms a stop-forming locking portion, which can cooperate with a locking portion of a similar coupled floor panel.

Floor panels of this type are known, amongst others, from the FIGS. 5-7, 8 and 9-11 of the aforementioned EP 1,415,056B1. In these known embodiments, the locking portion realized in the form of an insert consists of a synthetic material strip with an elastically bendable lip, which, during its bending, functions as a pivotable lock-up body. These known embodiments show the advantage that with a relatively simple construction, a so-called "push-lock" connection can be realized which is active over the entire length of the synthetic material strip. However, practice has shown that this known embodiment is not always functioning smoothly and that tolerances in a realized coupling sometimes are difficult to keep under control.

According to its first five aspects, the present invention aims at floor panels of the aforementioned specific type, which are further improved in respect to the aforementioned known embodiments. Thus, these improvements substantially consist in five aspects, which can be applied separately or in any imaginable combination.

To this aim, the invention according to a first aspect relates to a floor panel of the above-mentioned specific type, with the characteristic that the pivotable lock-up body, opposite from the extremity forming the locking portion, comprises a support portion, which is rotatable against a support surface pertaining to the floor panel concerned, and more particularly is rotatable in a seat. As the lock-up body is provided with a support portion which is rotatable against a support surface, and more particularly is rotatable in a seat, the rotational movement of the lock-up body is defined better than in the known embodiments, and a more precise coupling can be provided than, for example, in the case of an embodiment according to FIGS. 5-7, 8 and 9-11 of said EP 1,415,056B1. In this known embodiment, the pivotable lock-up body in fact is realized as a prolongation of an attachment portion, whereby the hinge function occurs in the material of the insert, and the precise rotational movement is difficult to predict, which may lead to a less optimum functioning.

According to a second independent aspect, the invention relates to a floor panel of the above-mentioned specific type, with the characteristic that the pivotable lock-up body, opposite to the extremity forming the locking portion, comprises a support portion and that the lock-up body, between the locking portion and the support portion, in itself is free from hinge portions and bending sections. As the lock-up body is free from hinge portions and bending sections, possible influences thereof on the shape and length of the lock-up body are excluded and a fixed useful length of the lock-up body can be guaranteed, such that, amongst others, small production tolerances can be maintained, allowing precise couplings. In connection therewith, it is thus preferred that the lock-up body is performed as a rigid element.

According to a third independent aspect, the invention relates to a floor panel of the above-mentioned specific type, with the characteristic that the pivotable lock-up body, opposite to the extremity forming the locking portion, comprises a support portion in the form of a free extremity, which, at least in vertical direction, is positively supported by a support portion pertaining to the floor panel. As the support portion is made as a free extremity, it does not experience influences from adjacent material portions in its support portion, which is beneficial for a smooth hinge motion of the lock-up body. By a free extremity is substantially meant that this simply is made as a protruding leg, without any further parts being attached thereto.

According to a fourth independent aspect, the invention relates to a floor panel of the above-mentioned specific type, with the characteristic that the lock-up body is rotatable around a rotation point, support point, respectively, and that the locking element comprises a press-on portion engaging at the lock-up body at a distance from the rotation point, support point, respectively. Thereby, it is possible to exert a suitable force with the press-on element against the pivotable lock-up body, even if this press-on element as such is relatively weak.

According to a fifth independent aspect, the invention relates to a floor panel of the above-mentioned specific type, with the characteristic that the vertically active locking system comprises a tensioning system which is formed by a cam surface formed at the extremity of the locking portion of the lock-up body, which cam surface, in coupled condition, provides for a wedge effect against the opposite locking portion of the coupled floor panel. Due to such configuration, the lock-up body, in coupled condition, always will settle well under the locking portion of the other floor panel. Due to small movements occurring when the floor panels are being walked on, the lock-up body, due to the wedge effect, will crawl farther under the locking portion of the other floor panel, whereby an even sturdier coupling is obtained. It is noted that this fifth aspect can be applied for all forms of rotatable locking portions, and thus, for example, also for embodiments, such as known from EP 1,415,056B1.

According to a sixth independent aspect, the invention relates to a floor panel comprising, at least at two opposite sides, coupling parts with which two of such floor panels can be coupled to each other; wherein these coupling parts form a horizontally active locking system and a vertically active locking system; wherein the horizontally active locking system comprises a male part and a female part, which allow to connect two of such floor panels to each other at the aforementioned sides by providing one of these floor panels with the pertaining male part, by means of a downward movement, in the female part of the other floor panel; and wherein the vertically active locking system comprises a locking element, which is provided in the form of an insert in one of the sides concerned; with the characteristic that the locking element consists of a co-extruded synthetic material strip provided in a recess, which strip, viewed in cross-section, is composed of two or more zones consisting of synthetic materials with different features. In other words, there are at least two zones of materials with different material characteristics. However, it is not excluded that certain zones do have the same material characteristics.

The use of such co-extruded synthetic material strip offers the advantage that the features can be selected depending on the function which certain parts of such strip have to fulfill. For example, certain parts, which have to exert a pressure force or tension force, can be realized in a rather elastic synthetic material, whereas parts which have to take up forces in an immobile manner, then better consist of a hard synthetic material. Preferably, then also use is made of synthetic materials with different flexibility, elasticity, respectively. Also, flexible synthetic materials may be applied in order to realize movable connections among different parts of the strip. According to still another possibility, by means of the coextrusion zones are realized which can provide for a better sealing, or which offer increased friction resistance. Summarized, it is so that the different synthetic materials are applied in function of the desired movability and/or the desired compressibility and/or the desired sealing effect.

It is clear that the sixth aspect extends to all "push lock" systems which apply a separate locking element which is provided or is to be provided in a recess in the edge of a floor panel, and is not exclusively restricted to locking elements with a pivotable lock-up body.

According to a seventh independent aspect, the invention relates to a floor panel comprising, at least at two opposite sides, coupling parts with which two of such floor panels can be coupled to each other; wherein these coupling parts form a horizontally active locking system and a vertically active locking system; wherein the horizontally active locking system has a male part and a female part, which allow to connect two of such floor panels to each other at the aforementioned sides by providing one of these floor panels with the pertaining male part, by means of a downward movement, in the female part of the other floor panel; wherein the vertically active locking system comprises a locking element, which is provided in the form of an insert in one of the sides concerned; with the characteristic that the locking element consists of a synthetic material strip provided in a recess, which strip, in the coupled condition of two floor panels, comes into contact with both floor panels and thereby forms a seal, wherein between the upper side of the floor panel and the synthetic material strip also a seal is present at the panel edges. The importance and advantage of this aspect will become clear from the following detailed description.

It is noted that all forms of combinations of the aforementioned seven aspects are possible.

Various advantageous dependent characteristics further will be described by means of the embodiments represented in the figures. All these dependent characteristics do not necessarily have to be applied in the mutual combinations as shown in the figures. Each characteristic can be combined as such with one of the independent aspects; such inasmuch as such dependent characteristic is not inconsistent with the characteristics of the respective independent aspect itself.

It is noted that the present invention preferably is applied for embodiments where the locking element, made as an insert, substantially, and still better exclusively, serves as a locking element assisting in the vertical locking and, thus, not in the horizontal locking. The horizontal locking preferably exclusively is performed by means of parts, such as the aforementioned male part and female part, which are made from the actual panel material, more particularly are mechanically formed therefrom. More particularly, the invention preferably relates to embodiments wherein the insert is produced separately and then is mounted in an edge of an actual floor panel, whether or not in a fixed manner.

More particularly, it is noted that the invention preferably is applied in embodiments where said locking element provides exclusively for an upward blockage, which means that this blockage prevents that the male part can come loose from the female element in an upward direction, whereas blockages in the other directions, thus, in downward direction and in horizontal direction, are obtained by the design of the panel edges themselves, in other words, by the coupling parts mechanically formed in the material of the panel.

Preferably, the invention relates to embodiments wherein at least the lock-up body, and still better even the entire locking element made as an insert, is realized relatively local, which more particularly means that it is only present between a first and a second horizontal level, of which the first horizontal level is situated at a distance beneath the upper side of the coupled floor panels, whereas the second horizontal level is situated lower than the first, however, higher than the lowermost point of the male part. Subsidiary thereto, it is, however, still preferred that said lock-up element extends over a height which is at least 40% and still better at least 50% of the height difference between the upper side of such coupled floor panels and the lowermost point of the male part. Using at least 40%, at least 50%, respectively, of this height in combination with said location between said first and second level offers various advantages. An advantage of embodiments fulfilling this consists in that a good compromise is achieved between sufficient compactness from the point of view of the possibility of a smooth application in the edge of a floor panel and from the point of view of the costs, on the one hand, and sufficient extent in order to optimize construction and shape of the locking element, on the other hand. Still another advantage in respect to the known embodiments of floor panels with a comparable total thickness, however, wherein the height of the lock-up body does not fulfill said ratio of at least 40%, is that, at least in the case of a pivotable lock-up body, a smaller rotation of this lock-up body already results in a relatively large deviation at the free extremity, whereby a good locking can be obtained in a smooth manner. As a consequence thereof, mostly a locked condition can be realized in which the lock-up element is standing relatively upright and extends under an angle with the vertical which is considerably smaller than 45%, whereby the lock-up element offers a particularly solid locking. This also allows working with a lock-up body of which the protruding exterior side is standing relatively upright, whereby this body during coupling can be pushed aside more smoothly by another panel. As the lock-up element in the locked condition is standing very upright, it is also obtained that the contact points of the lock-up body with the connected floor panels are located close to the panel edges, which is beneficial for a good connection.

The present invention relates to embodiments wherein said locking element is integrated in the male part, as well as to embodiments wherein said element is integrated in the female part. In the case of integration in the male part, the locking element preferably is situated in the distal side of this part, although integration in another side is not excluded. In the case of integration in the female part, the locking element preferably is situated at the proximal side, although integration in another side is not excluded.

Preferably, the coupling parts of the floor panels of the invention also are configured such that they can be uncoupled by means of a pivoting movement, irrespectively according to which of the aforementioned aspects they are realized. According to a particular embodiment, the coupling parts further are configured such that coupling by means of an angling movement is possible, too.

According to another embodiment, the male and the female part of said floor panels are configured such that said floor panels can be brought into each other at the sides concerned by shifting them towards each other, preferably even such that this is possible by moving them towards each other in a substantially same plane, for example, by shifting a panel towards another over an underlying surface. The locking then preferably takes place by means of a snap-on connection, wherein the hook-shaped part of the female part bends elastically during joining.

According to still another variant, said floor panels are realized such at the sides concerned that, apart from locking by means of a downward movement, also a locking by shifting the floor panels towards each other, as well as a locking and/or unlocking by angling the floor panels in mutual respect is possible.

It is noted that the configuration allowing that two floor panels at the same edges can be joined by means of a downward movement, thus, according to the "push-lock" principle, as well as by a mutual shifting in the same plane, thus, according to the principle of "snap action by means of shifting in the same plane", also more generally forms a particularity, without this combination necessarily having to be combined with one of said seven aspects. Due to this, the invention, according to an eighth aspect, thus also relates to a floor panel comprising, at least at two opposite sides, coupling parts with which two of such floor panels can be coupled to each other; wherein these coupling parts form a horizontally active locking system and a vertically active locking system; wherein the horizontally active locking system has a male part and a female part, which allow that two of such floor panels can be connected to each other at said sides by providing one of these floor panels with the pertaining male part, by means of a downward movement, in the female part of the other floor panel; wherein the vertically active locking system comprises a locking element, which is provided in the form of an insert in one of the sides concerned; wherein this locking element comprises a lip-shaped lock-up body; and wherein the lock-up body, at one extremity, forms a stop-forming locking portion, which can cooperate with a locking portion of a similar coupled floor panel; characterized in that the male part and the female part are configured such that two of such floor panels can be joined into each other at the sides concerned by shifting them with the sides concerned towards each other in the same plane. Hereby, the advantage is created that the installation comfort of such floor panels is considerably increased, as connecting by means of the downward movement allows for a rapid assembly, whereas the possibility of coupling together by shifting the floor panels towards each other offers the advantage that they can also be coupled to each other at locations where no downward movement is possible and solely coupling by shifting is possible, such as, for example, in the case that a floor panel partially must be provided underneath an overhanging element, such as a door frame, and from this position still has to be coupled to another floor panel.

It is clear that the invention also relates to floor panels combining the eighth aspect with one or more of the preceding aspects.

Floor panels meeting the eighth aspect preferably also show one or more of the following characteristics:

the coupling parts concerned are performed at the aforementioned sides such, that they allow a locking and/or unlocking of two of such floor panels in mutual respect by mutually angling them into each other, out of each other, respectively;

in free condition, the lip-shaped lock-up body protrudes outward in an inclined manner;

the lock-up body is provided in the proximal side of the female part;

the female part and the male part comprise contact surfaces at their distal extremities, said surfaces being performed upwardly inclined in distal direction;

the lip-shaped lock-up body is a pivotable body.

According to a particularly preferred embodiment, the floor panels of the eighth aspect relate to rectangular, either oblong or square, panels, and a pair of opposite sides of said coupling parts is provided according to the eighth effect, whereas the other, second pair of opposite sides comprises coupling parts, which also can provide for a vertical and horizontal locking, of which kind whatsoever, however, which still allow that two of such floor panels can be joined into each other at the last-mentioned sides by substantially shifting them with the sides concerned towards each other in the same plane. This combination of possibilities offers an even higher comfort of installation in difficult situations. According to an additional preferred characteristic, the coupling parts at the second pair of opposite sides also are configured such that they allow angling the floor panels in and out of each other. Examples of such coupling parts are widely known from the state of the art, for example, from FIG. 23 of WO 97/47834.

According to still another particular embodiment, the coupling parts of the eighth aspect are applied at both pairs of sides.

Further, the invention according to a ninth aspect also relates to a floor panel comprising, at least at two opposite sides, coupling parts with which two of such floor panels can be coupled to each other at the respective edges; wherein these coupling parts form a horizontally active locking system and a vertically active locking system; wherein at least one of the locking systems comprises a locking element, which is provided in the form of a separate insert at one of the edges concerned; wherein this locking element comprises at least a movable lock-up body; and wherein the lock-up body, at one extremity, forms a stop-forming locking portion, which can cooperate with a locking portion of a similar coupled floor panel; with the characteristic that the locking element consists of a synthetic material strip which, viewed in cross-section, is composed of at least two zones of materials with different material characteristics. By making use of a separate insert formed of different materials, the advantage is created that the different portions of the insert can be optimized in function of their purpose. So, for example, may the lock-up body be realized relatively rigid in order to be able to adequately withstand occurring forces, whereas one or more other portions, which must provide the movability of the lock-up body, then as such are realized relatively flexible.

Preferably, the floor panel according to the ninth aspect further is characterized in that the lock-up body is attached directly or indirectly to a material part pertaining to the locking element or is made in one piece therewith, which allows an elastic movement of the lock-up body, wherein this material part consists of a material which as such is more flexible and bendable than the material of which the lock-up body basically is formed.

According to still another preferred characteristic, the aforementioned material part is performed as a local hinge part, with the advantage that a very precisely defined pivoting movement is obtained.

Herein, it is preferred that said material part forms a connection between the lock-up body and an attachment portion, wherein the lock-up body and the attachment portion consist of material which is less flexible than said material part. In this manner, it is obtained that an adequate locking is created by means of the relatively rigid lock-up body, whereas by means of the relatively rigid attachment portion a stable positioning of the locking element in a recess in the edge of the floor panel concerned is possible.

In a preferred embodiment of the ninth aspect of the invention, the attachment portion consists of an attachment body which, viewed in cross-section, extends in a flat or rather flat direction, which means substantially in the plane of the floor panel, which attachment body is provided in a recess. Such attachment portion allows an adequate attachment, also when the invention is applied in relatively thin floor panels. Another advantage is that by somewhat altering the direction with which this attachment portion is applied in the floor panel, different functioning characteristics can be obtained and the engineer in this manner can provide for an optimization.

Also according to the ninth aspect, the floor panel will be characterized in that the lock-up body can be elastically angled out with an extremity; that the lock-up body, globally seen, forms an angle with the attachment portion; that the lock-up body, with the extremity situated opposite to the extremity which can be angled out, protrudes up to beyond the attachment portion; that said material part makes a connection between said extremity protruding beyond the attachment portion and an adjacent portion of the actual attachment portion; and that at the location where the lock-up body passes along the attachment portion, the distance between the lock-up body and the attachment portion is smaller than the distance from the protruding extremity of the lock-up body to the attachment portion. As will become clear from the further description, this offers various advantages.

In the most preferred embodiment, the locking element of the ninth aspect of the invention is formed by means of coextrusion.

The ninth aspect is particularly useful with floor panels of the type which is characterized in that the horizontally active locking system comprises a male part and a female part, which allow that two of such floor panels can be connected to each other at said sides by providing one of these floor panels with the pertaining male part, by a downward movement, in the female part of the other floor panel, in other words, floor panels of the so-called push-lock type. However, it is noted that the ninth aspect is not restricted to this type of floor panels and in principle can be applied for each type of coupling for floor panels wherein a horizontally active locking system and vertically active locking system are applied, wherein in one or the other way a separate locking system is integrated. So, for example, it is possible to integrate the ninth aspect in strip-shaped locking elements of the type such as known from WO 2006/104436, more particularly FIGS. 9*c*, 9*e* and 9*f*.

It is clear that the characteristics of the ninth aspect also can be combined with the characteristics from the first eight aspects.

BRIEF DESCRIPTION OF THE DRAWINGS

With the intention of better showing the characteristics of the invention, hereafter, as an example without any limitative character, several preferred embodiments are described, with reference to the accompanying figures, wherein.

DETAILED DESCRIPTION OF PREFERRED EMBODIMENTS OF THE INVENTION

As represented in FIGS. 1 to 5, the invention relates to a floor panel 1 comprising, at least at two opposite sides 2-3, coupling parts 4-5, with which two of such floor panels 1 can be coupled to each other.

Figure 3:
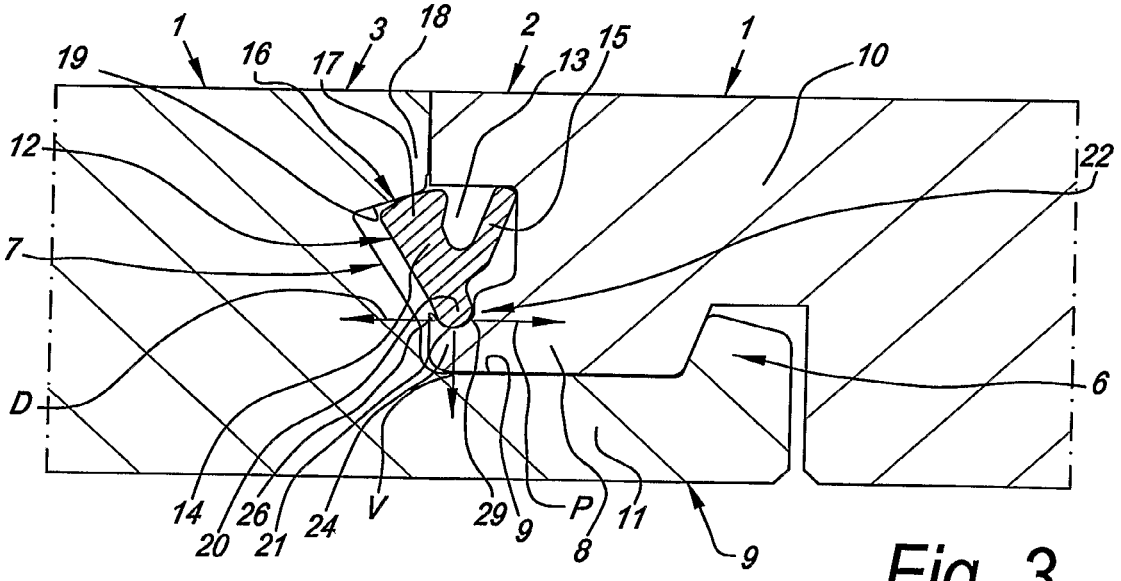
FIG. 3 in cross-section represents two floor panels, which are made according to FIG. 2, in coupled condition.

As becomes clear from the coupled condition of FIG. 3, these coupling parts 4-5 comprise a horizontally active locking system 6 and a vertically active locking system 7. The horizontally active locking system 6 comprises a male part 8 and a female part 9, which allow to connect two of such floor panels 1 to each other at the aforementioned sides 2-3 by providing one of these floor panels 1 with the pertaining male part 8, by means of a downward movement M, in the female part 9 of the other floor panel, which movement M is illustrated by means of two different positions in the FIGS. 4 and 5.

The male part 8 is formed by a downward-directed extremity of a hook-shaped part 10, whereas the female part 9 consists of a seat formed by means of an upward-directed hook-shaped part 11.

The vertically active locking system 7 comprises a locking element 12, which, in the form of an insert, is provided in one of the sides concerned, in this case, the side 2, more particularly in a recess 13 provided to this aim. For clarification, the locking element 12, or in other words, thus, the insert, is illustrated in separate condition in FIG. 6. As can be seen in this figure, this locking element 12 preferably is made as a strip. It is clear that this strip preferably extends over the entire or almost entire length of the side 2.

Preferably, this strip consists of synthetic material, however, the use of other materials to this aim is not excluded. Further, it is preferred that the strip has a continuous cross-section over its entire length, which renders it simple to manufacture. In the case of a synthetic material strip, preferably use is made of PVC.

Figure 7:
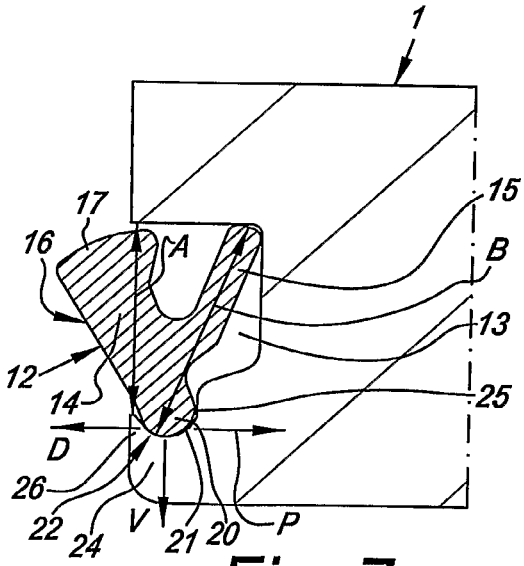
FIG. 7, at a larger scale, represents the portion indicated by F7 in FIG. 2.

The enlarged view of FIG. 7 shows in greater detail how the strip is attached in the recess 13, which will be discussed further on.

Figure 6:
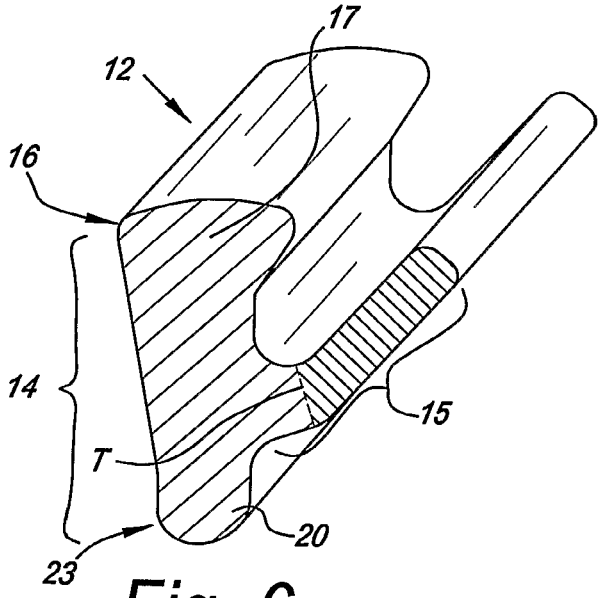
FIG. 6, at a larger scale, represents the locking element applied in the embodiment of FIGS. 2 to 5.

In the represented example, the locking element 12 is composed at least of a pivotable lock-up body 14 and a press-on portion 15. In the embodiment of FIG. 6, the lock-up body 14 consists of the entire upright part, whereas the press-on portion 15 is formed by the portion inclinedly directed away.

Figure 4:
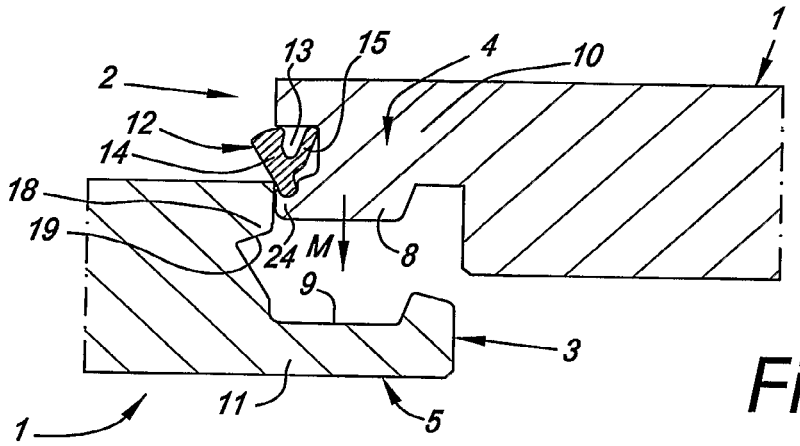
FIGS. 4 and 5 represent the floor panels from FIG. 3 in two different steps during the joining.
Figure 5:
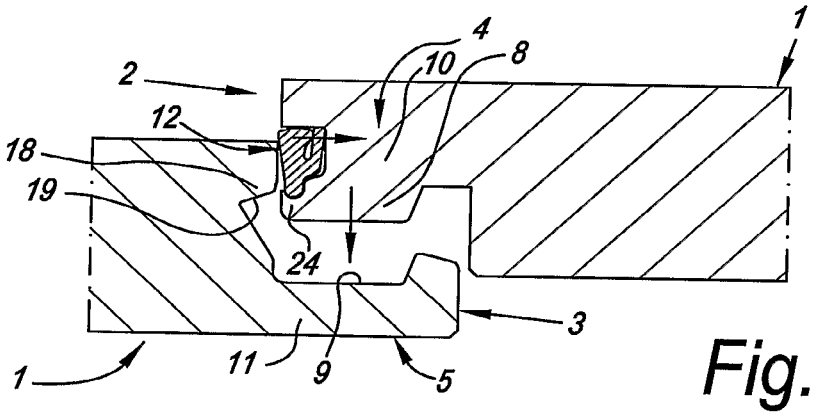

The extremity 16 of the lock-up body 14, which can be rotated out, functions as a stop-forming locking portion 17, which can cooperate with a locking portion 18 of a similar coupled floor panel 1. Herein, the locking portion 18 preferably is formed by a portion defining a stop-forming surface 19, which for this purpose is present in the side 3 and preferably is mechanically provided in the core of the floor panel 1. The functioning of the vertically active locking system can simply be deduced from the figures and relies on the principle that, as represented in FIGS. 4 and 5, when moving the floor panel concerned downward, the lock-up body 14 is elastically folded inward by the contact with the edge of the other floor panel, after which, as soon as the floor panels have arrived in the same plane, the lock-up element rotates back outward in order to position itself beneath the locking portion 18, such that the coupled condition of FIG. 3 is created.

In accordance with the first aspect of the invention, the pivotable lock-up body 14, opposite from the extremity 16 forming the locking portion 17, comprises a support portion 20, which is rotatable against a support surface 21 pertaining to the floor panel 1 concerned, and more particularly in a seat 22. By the support portion 20 in the embodiment of FIGS. 2 to 10 thus the lowermost extremity 23 of the lock-up body 14 is meant.

Further, the lock-up body 14 as such, between the locking portion 17 and the support portion 20, in other words, between its extremities 16 and 23, is free from hinge portions and bending sections, such in accordance with the second aspect of the invention. To this aim, thus, the lock-up body 14 is made relatively thick and preferably forms a rigid body, which means that the lock-up body 14 can not undergo noticeable deformations between its extremities when pressures are exerted hereupon, which usually may arise with "push-lock" couplings.

In accordance with the third aspect of the invention, the support portion 20 in the represented embodiment is made as a free extremity, which is positively supported at least in vertical direction by a support portion 24, more particularly support surface 21, pertaining to the floor panel 1.

As can be clearly seen in FIGS. 3 and 7, the support portion 20 of the lock-up body 14 preferably even is supported in two directions, at least in a coupled condition of two floor panels 1, namely in vertical direction V, in this case, thus, downward, as well as in proximal direction P in respect to the floor panel 1, this latter by means of the lateral wall 25 of the seat 22.

In the represented example of FIGS. 1 to 10, the floor panel 1 also comprises a stop-forming part 26, which, in a distal direction D in respect to the floor panel 1, forms a blockage for the support portion 20 or, thus, for the extremity 23 of the lock-up body 14. Thereby, a proper seat 22 can be formed, as a result of which the support portion 20 is sitting enclosed at three sides. In this manner, the seat can function as a rather precisely defined hinge point.

Generally, it can be stated that the locking element 12 preferably consists of a strip which is attached in a recess, in the represented example, thus, the recess 13, in the floor panel 1 and that attachment provisions are present therein, retaining the strip in the recess. More particularly, it is preferred that the strip is snap-fitted in the recess and/or is sitting enclosed therein due to the design, which principle also has been applied in the embodiment of FIGS. 1 to 10. As indicated in FIG. 7, the opening A of the recess is smaller than the largest dimension B of the strip, with the consequence that the latter automatically is retained in the recess 13.

It is noted that other techniques for attaching or retaining such strip in the recess are possible, for example, by gluing, clamping or the like. A number of advantages are described in the following.

Figure 8:
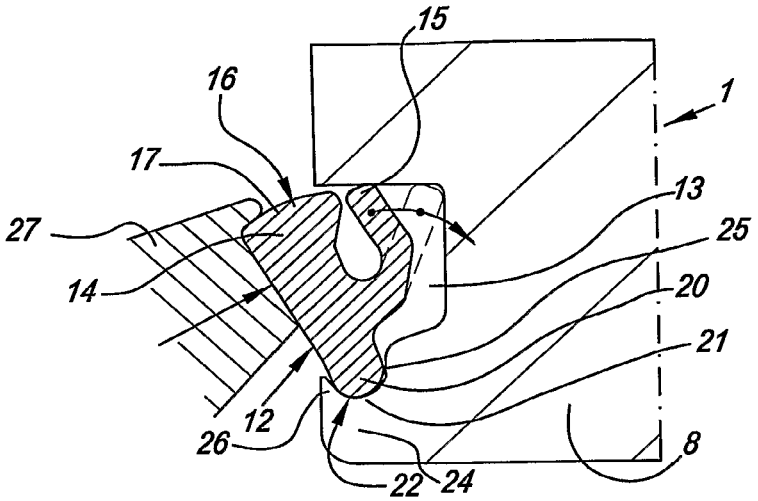
FIG. 8 schematically represents how the locking element of FIG. 7 can be mounted in a floor panel.

As schematically illustrated in FIG. 8, the strip or, thus, the locking element 12 simply can be provided at a floor panel 1 by pressing it into the recess 13, for example, by means of a press-on portion or sliding block 27. Due to the exerted pressure, the strip is deformed and fits through opening A, after which it regains its original shape and becomes enclosed in the recess. More particularly, hereby the press-on portion 15 is bent in the manner as represented, in order to finally bounce into place.

The embodiment of FIGS. 1 to 10 also applies the fourth aspect of the invention, namely in that the lock-up body 14 is rotatable around a rotation point, support point, respectively, and the press-on portion 15, at a distance from the rotation point, and more particularly at a distance D1 from the actual support point, engages at the lock-up body 14. It is noted that by a "point", also a "zone" can be intended. Thus, a "support point" also may extend over a "zone".

As represented, the press-on portion 15 preferably consists at least, viewed in cross-section, of a leg adjoining to the rear side of the lock-up body 14, which leg, in free condition, extends obliquely in respect to the lock-up body 14, such from a location P1 situated between the two extremities of the lock-up body. Preferably, this leg also globally extends under an angle A1 of less than 70 degrees in respect to the portion 28 of the lock-up body 14, which portion extends from said location P1 towards the locking portion 17.

The press-on portion 15 preferably consists of an elastic material, and more particularly a material, which as such is more flexible than the material of the lock-up body 14. Preferably, this is also synthetic material, and in the most preferred embodiment, the press-on portion 15 is made in one piece with the lock-up body 14 by means of coextrusion.

Figure 9:
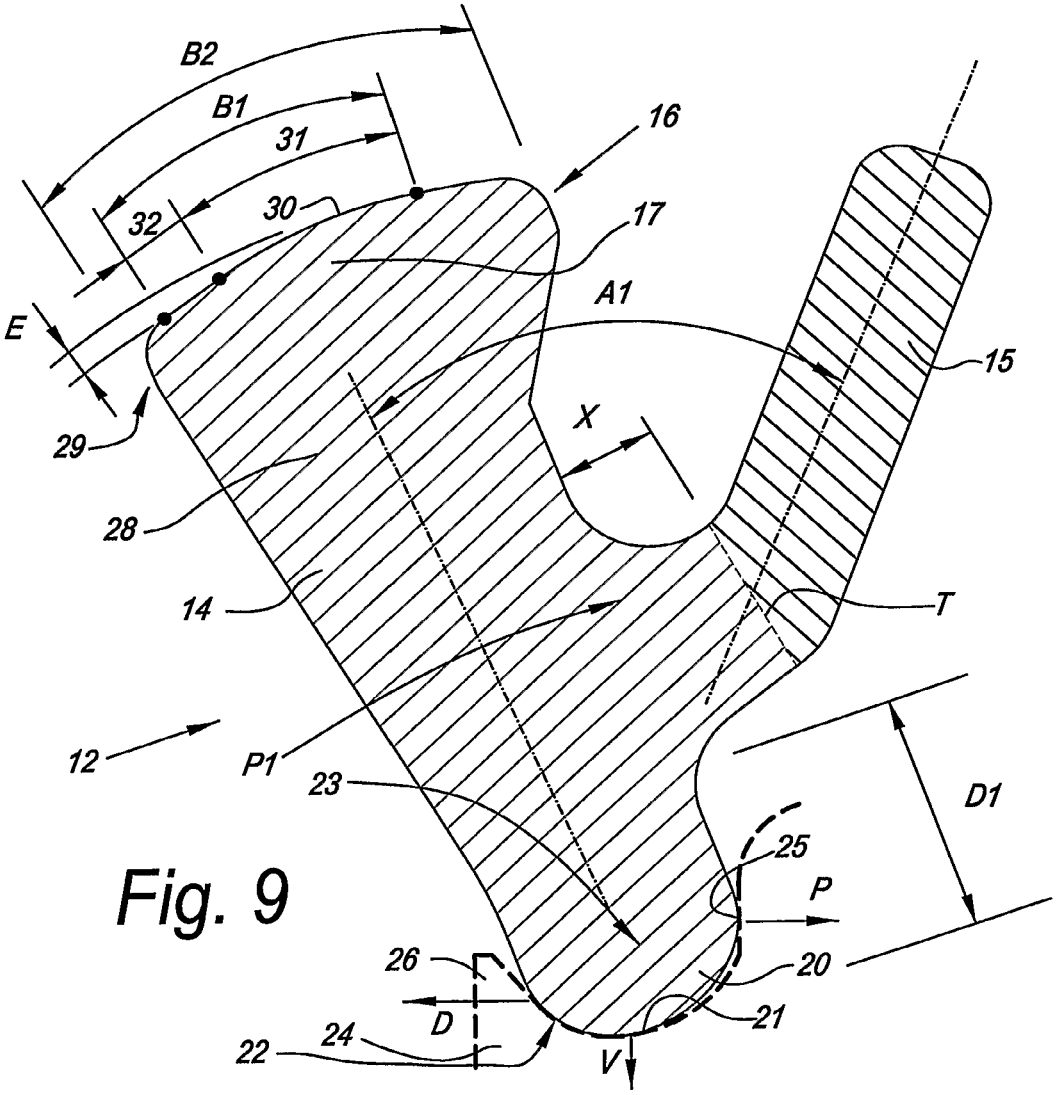
FIG. 9 represents the locking element of FIG. 6 in cross-section and at a strongly enlarged scale.

In the enlarged views of FIGS. 6 and 9, the co-extruded materials are represented with different shading.

Generally, it is noted that a locking element 12 in cross-section can only be of small dimensions, in view of the fact that it must be integrated in the edge of floor panels having in practice a thickness which usually is less than 2 cm and in many cases is even less than 1 cm. Thus, the space then available for the locking element 12 often only lies in the order of magnitude of 5 millimeters or less. When with such small dimensions different flexibilities must be incorporated into the locking element, the possibilities thus also are limited when one desires to perform this in a traditional manner by working with different thicknesses. By now using coextrusion according to the invention, a broader range of possibilities is created for incorporating different flexibilities, and thus also a different elasticity, depending on the intended effect.

The co-extruded materials may consist of the same or similar basic material and, for example, differ from each other only in that certain components are added to the one material, or certain components are present to a larger extent. In a practical embodiment, the entire strip will consist of PVC, however, the more flexible portion will be formed of PVC to which a larger quantity of plasticizer is added.

Also the location of the transition T between the co-extruded materials is of importance. So, for example, this transition T, in the embodiment of FIGS. 1 to 10, preferably is situated at a distance X from the lock-up body. Thereby, a more rigid guiding portion remains present at the basis of the press-on portion 1, which promotes the snap-on effect represented in FIG. 8.

In the embodiment of FIGS. 1 to 10, the press-on portion 15, viewed in cross-section, consists of only one leg.

In the embodiment of FIGS. 1 to 10, a tensioning system 29 is integrated in the vertically active locking system, which tensioning system provides for that a good locking is created when the lock-up body 14 is angled out. By a tensioning system, here a system is intended which, when angling out the lock-up body 14, additionally effects the approach among the locking portions 17 and 18.

Figure 10:
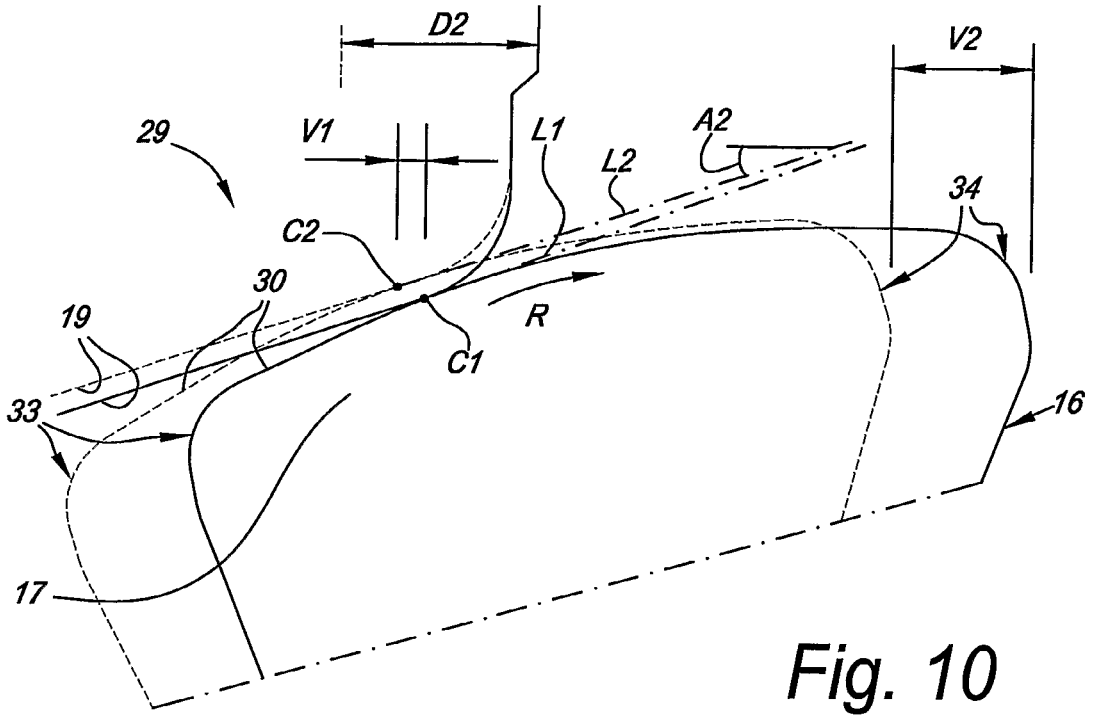
FIG. 10, at a still larger scale, represents the uppermost extremity of the locking element of FIG. 9, together with a locking portion with which it comes into contact.

As made clear in the larger representations of FIGS. 9 and 10, in the embodiment of FIGS. 1 to 10 to this aim use is made of a cam surface 30 formed at the extremity 16 of the lock-up body 14, which cam surface, in coupled condition, provides a wedge effect against the opposite locking portion 18 of the coupled floor panel 1.

As indicated in FIG. 9, the cam surface 30, which consists at least of an effective contact zone 31 and possibly an entry zone 32, preferably extends over a width B1 of at least 60% of the total width B2 of the lock-up body 14, which allows providing a gradual transition, which promotes a good wedge effect. Indeed, the entry zone 32 preferably is somewhat steeper than the contact zone 31 and is intended to provide for that the lock-up body 14 initially always will get smoothly beneath the surface 19.

Herein, the cam surface 30 preferably extends such that, as represented in FIGS. 9 and 10, according to a direction R, from the most outwardly situated edge 33 to the most inwardly situated edge 34, the cam surface 30 shows an increasing elevation E, such that the effective length of the lock-up body 14 increases for the successive points of the cam surface according to the direction R. Herein, the effective length is the distance between the locations where the lock-up body comes into contact at the top and at the bottom.

The cam surface 30 and the surface 19 situated opposite thereof preferably are performed such that a displacement of the lock-up body 14 as a consequence of tolerance differences results in a smaller or no displacement of the contact zone, more particularly the contact point, between both locking portions 17 and 18. Preferably, therein the amount of the displacement of the contact zone or the contact point is less than 50% of the size of the displacement of the cam surface 30. This is illustrated in the following by means of FIG. 10. Herein, a first condition with a contact point in position C1 is represented in solid line. When, due to settling, the surface 19 comes to lie somewhat higher, a condition is created such as represented in dashed line, wherein the contact point is displaced from a position C1 to C2, and such according to the invention with a displacement V1, which is noticeably smaller than the displacement V2 of the lock-up body 14. The advantage herein is that at all times, the displacement V2 is small, and it can be guaranteed that the contact always takes place within a certain distance D2 from the upper edges of the floor panels 1 and a too far outward rotation, which might lead to a weak connection, is excluded. With tolerance differences, too, the same effect occurs. A first pair of floor panels may come into contact, for example, as represented in solid line, whereas another pair, due to tolerance differences, comes into contact as represented in dashed line. Due to a cam shape according to the invention, it is then prevented that in the second case the contact point C2 would be situated too far from the edges of the floor panels.

It is noted that, as represented in the figures, the locking portion 17 of the lock-up body 14 preferably is performed in the form of a broadened extremity of the lock-up body 14, due to which more space is offered for realizing a desired cam surface 30.

The inclinations of the cam surface 30 and the surface 19 cooperating therewith preferably are realized such that they always define a tangent line L1-L2 in their contact zone, contact point C1-C2, respectively, the inclination angles of which with the horizontal, of which solely one is indicated in FIG. 10 by A2, are less than 35 degrees.

Figure 11:
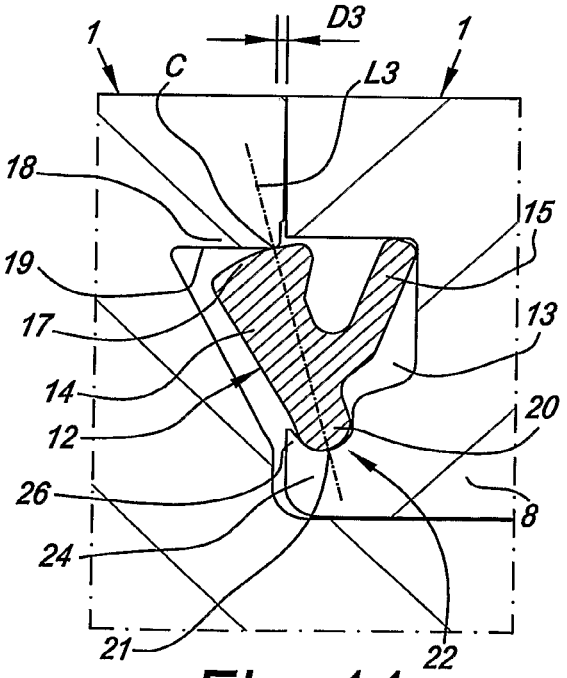
FIGS. 11 and 12 represent two variants.
Figure 12:
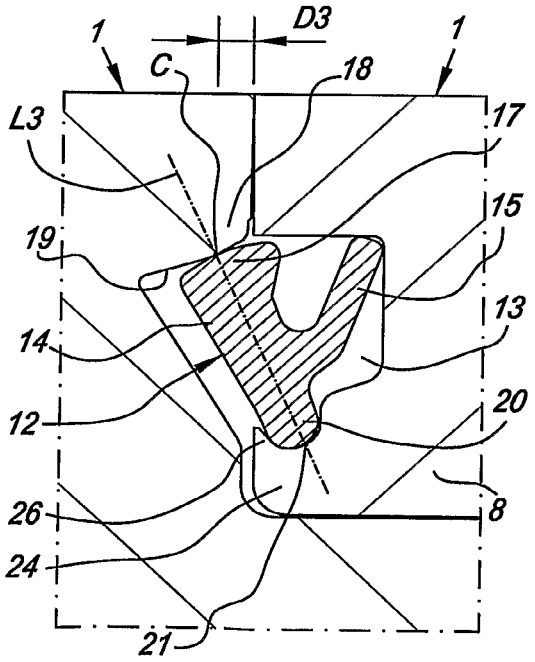

FIGS. 11 and 12 show that the contact point C can also be displaced by the selection of the shape of the surface 19 with which the lock-up body 14 cooperates in coupled condition. It is noted that in coupled condition the connection line L3 between the contact point C, or the middle of the contact zone when the contact is wider than a point, and a point where the lock-up body 14 is supported, is as vertical as possible, as then, amongst others, horizontal force components, which might force the lock-up body back, remain limited. In this respect, it is also preferred that the distance D3, at which the contact C, the center op the contact zone, respectively, is situated from the plane where the floor panels 1 fit against each other, is smaller than 1 mm and still better is smaller than 0.8 mm.

Figure 1:
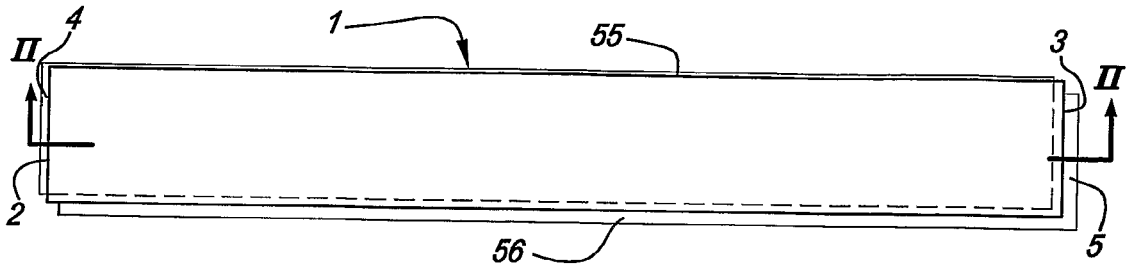
FIG. 1 schematically and in top plan view represents a floor panel according to the invention.
Figure 2:
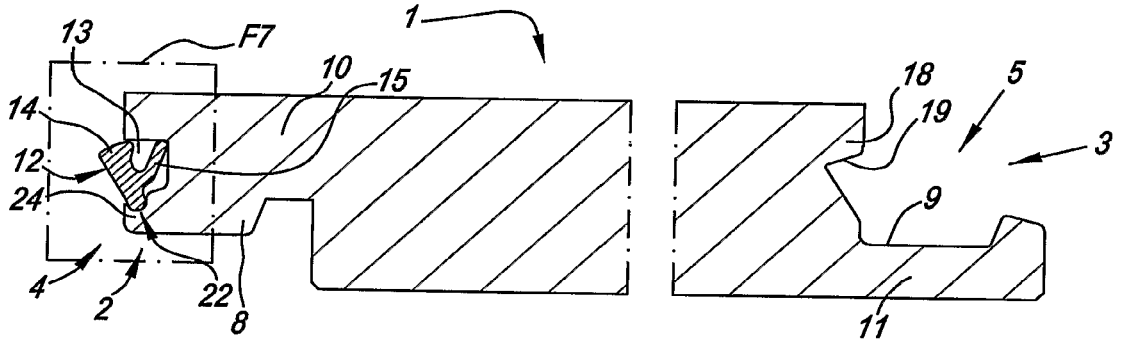
FIG. 2, at a larger scale, represents a cross-section according to line II-II in FIG. 1.

As represented in FIGS. 2 and 7, the locking element 12 and the recess 13 are performed such that this locking element 12, in the free, uncoupled condition of the floor panel 1 concerned, is sitting at least partially with its locking portion 17 within the recess 13. This offers, amongst others, the advantage that the strip, of which this locking element consists, when two floor panels 1 are joined into each other by means of a downward movement, in principle never can be pulled out of its seat by friction forces or for any other cause, due to which the good functioning might be disturbed.

It is clear that the coupling according to the invention can be applied in combination with any floor panel 1.

Figure 13:
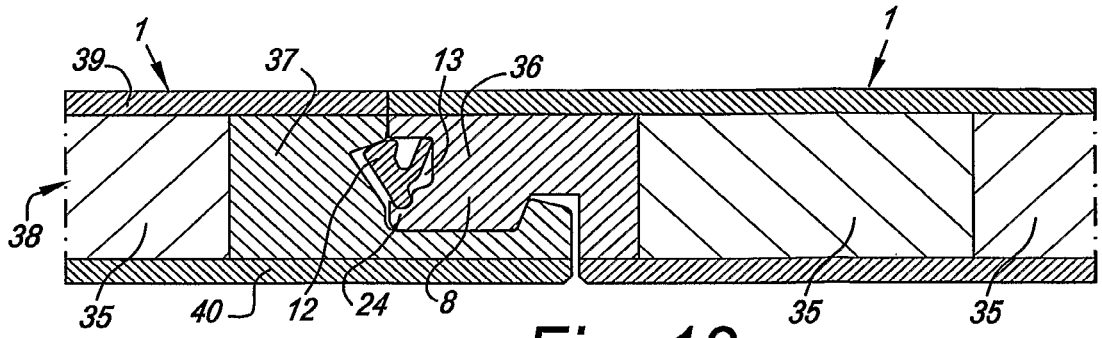
FIGS. 13 and 14 represent two practical embodiments.

FIG. 13 shows the application of the embodiment represented in FIGS. 1 to 10 in so-called prefabricated parquet, more particularly in so-called "engineered wood". In this example, this relates to floor panels 1 which are constructed from a core 38 composed of strips 35-36-37, a top layer 39 of wood, as well as a backing layer 40 of wood. The top layer 39 consists of wood of a good quality, which functions as a visible decorative layer. The backing layer 39 may consist of a cheaper kind of wood. The strips 35 preferably also consist of a cheaper, for example, soft kind of wood. However, it is preferred that at the extremities of the floor panels 1 strips 37-38 of a material are applied which is relatively sturdy and suited for providing the desired profile shapes therein, for example, milling them therein. In a practical embodiment, these strips 37-38 consist of MDF (Medium Density Fiberboard) or HDF (High Density Fiberboard). It is clear that the invention can also be applied in combination with other forms of "engineered wood", for example, wherein the core consists of a single continuous MDF/HDF board or of a plywood board.

Figure 14:
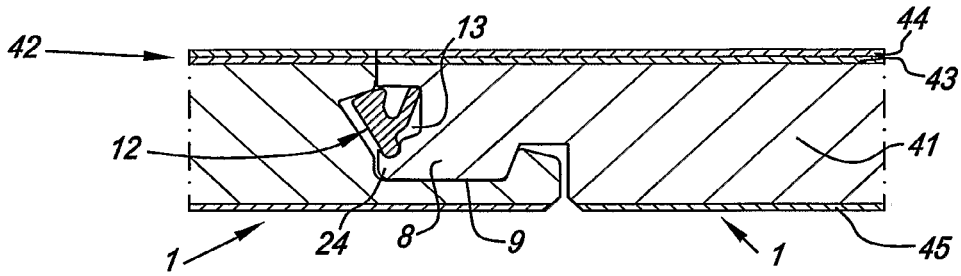

FIG. 14 represents an application in a laminate floor panel, in this case a so-called DPL (Direct Pressure Laminate), which, in a known manner, consists of a core 41, for example, of MDF or HDF, a top layer 42 on the basis of one or more resin-impregnated layers, for example, a printed decor layer 43 and a so-called overlay 44, as well as a backing layer 45, which also consists of one or more resin-impregnated layers, wherein the whole is consolidated under heat and pressure.

Applications in other floor panels 1 are not excluded.

Figure 15:
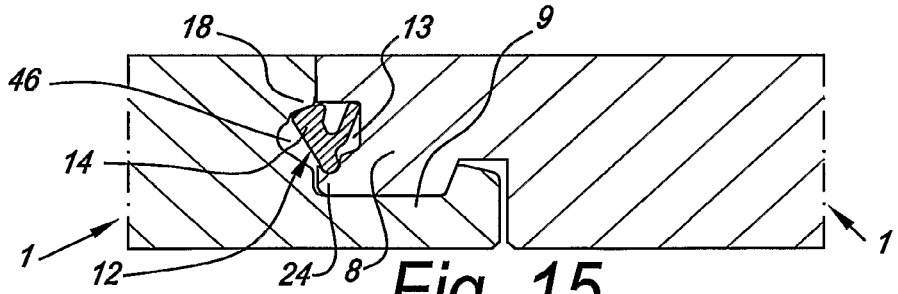
FIGS. 15 and 16 represent a particular embodiment.
Figure 16:
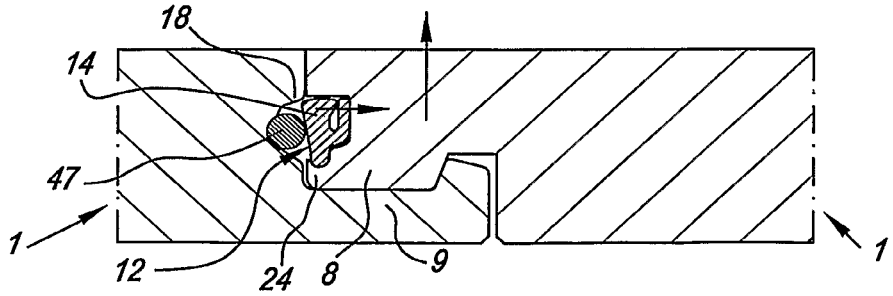

FIGS. 15 and 16 represent a particular embodiment, wherein in the side of the floor panel 1 situated opposite to the lock-up body 14, a recess 46 is provided, wherein, as can be seen in FIG. 16, in the longitudinal direction of the edges a rod 47 or the like can be introduced between the floor panels 1, in such a manner that the lock-up body 14 is pushed back and the floor panel concerned can be lifted and thus can be uncoupled.

Figure 17:
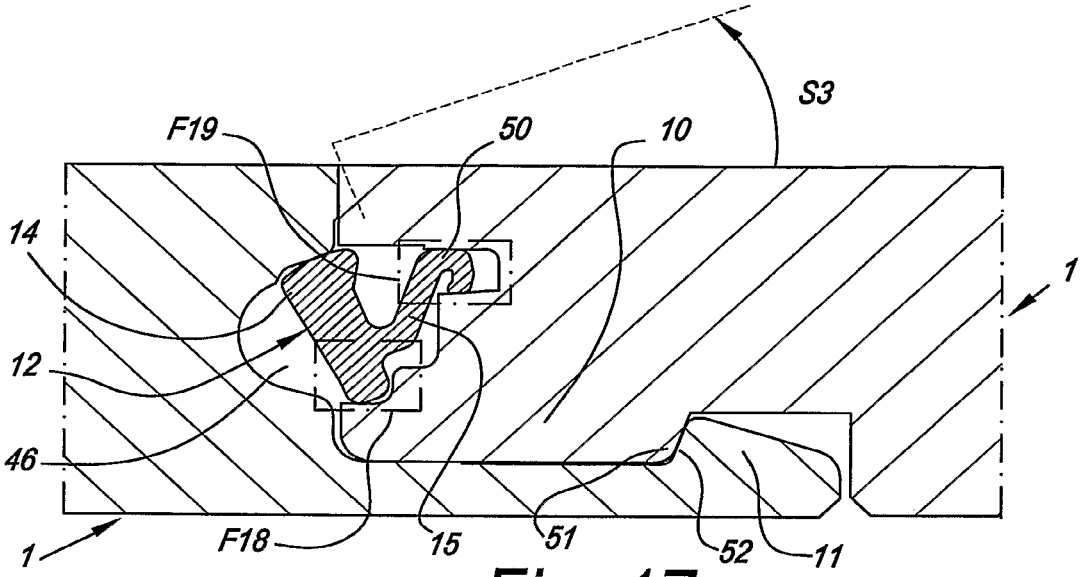
FIG. 17 represents still another embodiment of the invention.
Figure 18:
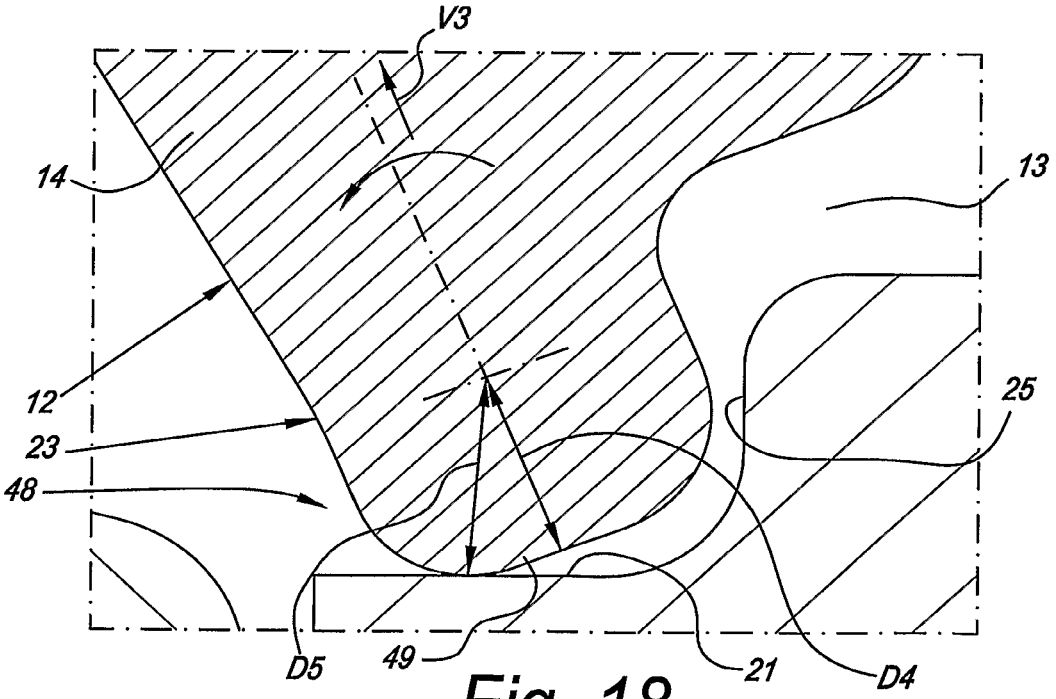
FIGS. 18 and 19, at a larger scale, represent the portions indicated by F18 and F19 in FIG. 17.

FIG. 17 represents a variant of the invention, which differs from the above-described embodiment in a number of ways. So, for example, does the pivotable lock-up body 14, next to the extremity 23 along which it is pivotable, comprise a tensioning system 48, which in this example, as illustrated in the enlarged view of FIG. 18, substantially consists of a cam 49 realized at said extremity 23, which cam, when the lock-up body 14 is being pivoted outward, also subjects this lock-up body 14 to an axial displacement V3 in the direction of the locking portion 17. It is clear that the cam 49 to this aim must be realized with a suitable elevation, which can be determined by those skilled in art in function of the desired effect. In FIG. 18, the elevation is illustrated by the distances D4 and D5, wherein D5 is larger than D4. The axial displacement V3 contributes to that the lock-up body 14, during coupling, initially can pivot outward in a smooth manner, however, as soon as it is partially pivoted out, rather quickly is seeking contact with the other floor panel 1 before it can pivot outward too far.

In the embodiment of FIG. 17, also no distal stop-forming portion is present, as a result of which the locking element can be pressed into the recess 13 more smoothly. As can be seen in FIG. 18, the lock-up body 14, instead of a purely pivoting movement, then possibly also may perform a rolling movement, whereby it possibly distances itself somewhat from the proximal lateral wall 25, however, due to settling of the whole when the floor is walked upon, or under the influence of other forces, indeed can take place against this wall again.

Figure 19:
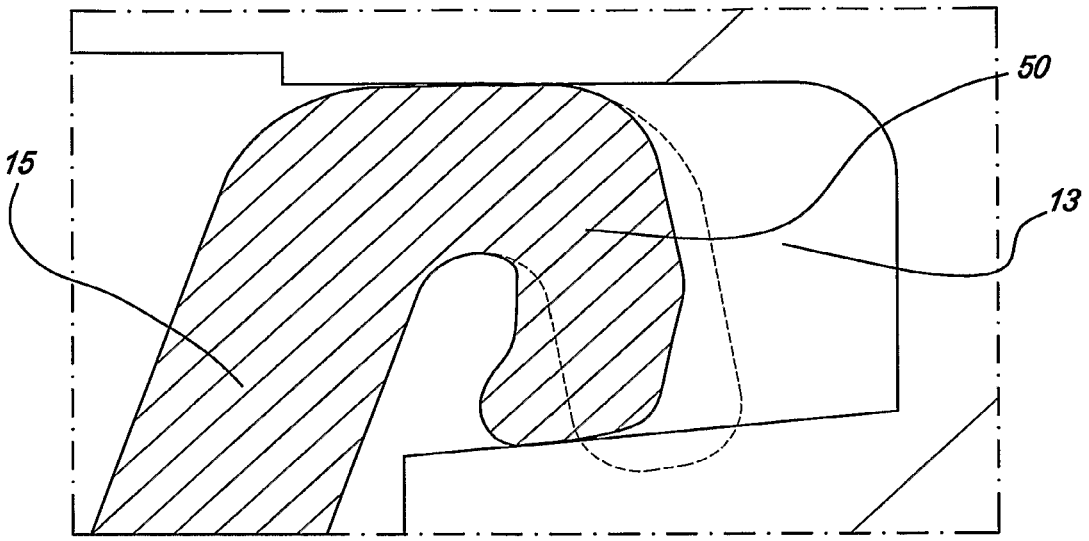

In the embodiment of FIG. 17, the locking element also is provided with an attachment portion 50 especially provided for this purpose, which portion in this case is performed as a clamped part. As clearly represented in FIG. 19, the clamping action herein is obtained by an elastic bending and/or deformation of the attachment portion 50.

Figure 20:
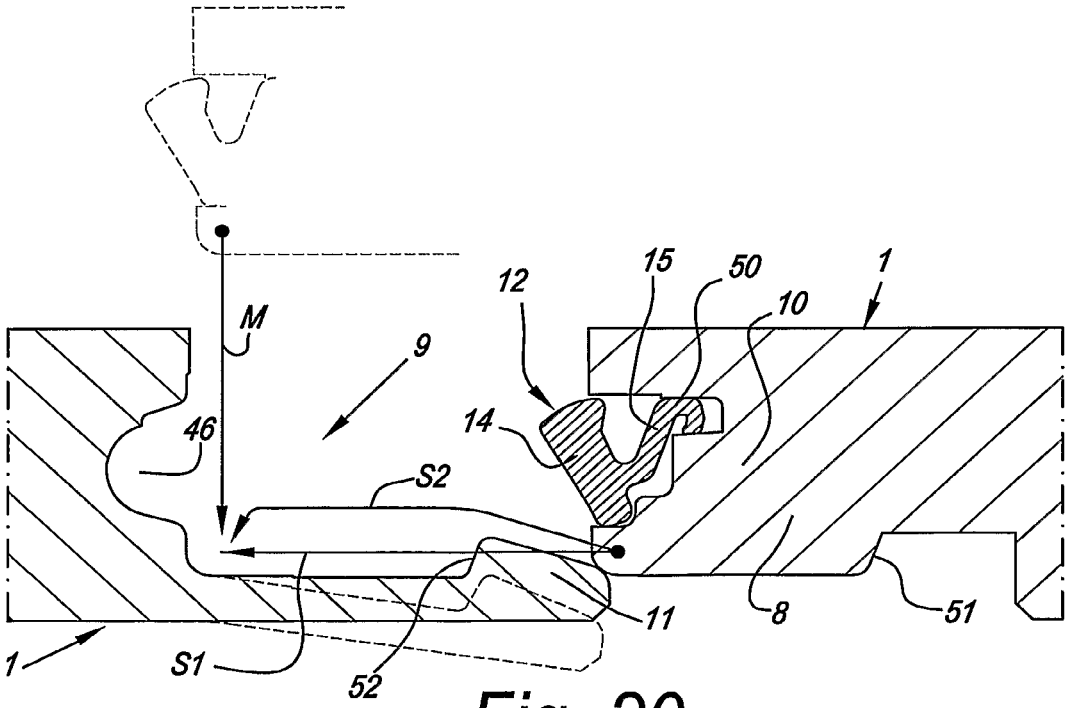
FIG. 20 represents a particular fashion of coupling together two floor panels made according to FIG. 17.

FIG. 17 also shows that the female part 9 can be performed with a relatively low hook-shaped part 10 and further may have such a shape that two of such floor panels 1 can be brought into each other at the respective edges also by sliding them towards each other, whether or not assisted by the fact that the hook-shaped part 11 possibly is elastically bendable. This manner of joining is illustrated in FIG. 20. Herein, two possibilities can occur. When the floor panels 1 are held in the same plane and are moved towards each other in this manner, such as indicated by arrow S1, the hook-shaped part 11 is forced to bend out elastically downward. When the floor panels 1 have been slid with their upper edges against each other, the lock-up body 14 automatically comes into the locking position, whereas the bent-out hook-shaped part 11 also bounces back and comes to sit behind the male part 8. When the floor panel 1 comprising the lock-up body 14 at its edge to be coupled is freely movable in height, then during joining a movement according to arrow S2 will take place, wherein the male part 8 arcuately slides over the hook-shaped part 11 in order to finally drop until a locking is obtained. Of course, also combinations of both movements may take place.

As schematically indicated in FIG. 17 by arrow S3, the represented coupling parts also allow that two of such panels can be coupled and/or uncoupled by an angling movement, such by applying a suitable height of the hook-shaped part 11 and/or a suitable inclination of the contact surfaces 51-52.

It is clear that all characteristics described above by means of FIGS. 17 to 20 optionally can also be integrated into other embodiments of the invention.

Figure 21:
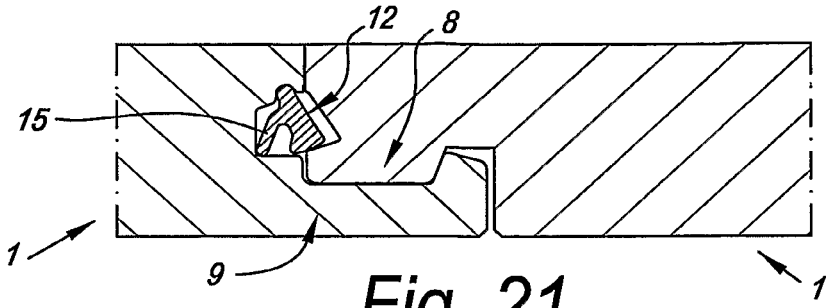
FIGS. 21 to 24 represent another four embodiments of the invention.

It is noted that the locking element 12 according to the invention can be taken up into the sides 2-3 to be coupled at various locations. For example, FIGS. 21 to 23 represent three embodiments, wherein this element is provided at the female part 9 instead of the male part 8, whereas FIG. 24 represents an embodiment, wherein the locking element 12 is provided in the edge region and thus not in the actual seat where the male part fits into the female part.

Figure 22:
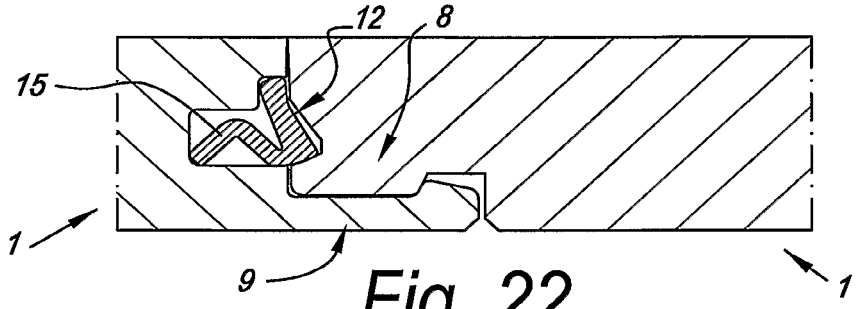

The embodiment of FIG. 22 shows that the press-on portion 15 also may have a bent or folded-over shape.

Figure 23:
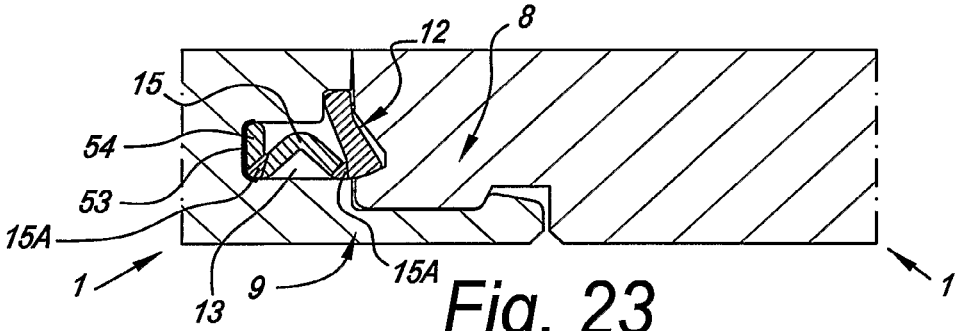
Figure 24:
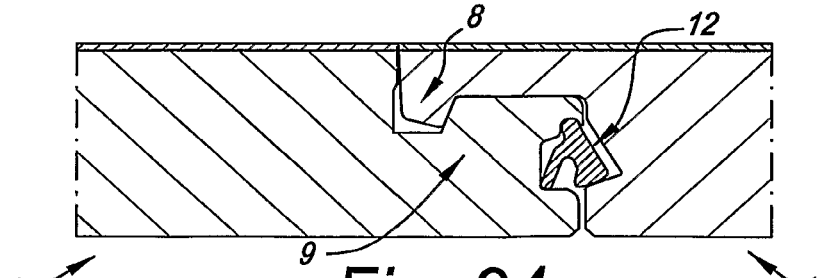

FIG. 23 represents that the locking element can also be attached in the recess 13 by means of glue 53, possibly by means of a portion especially provided for this purpose, such as an attachment lip 54, which, for example, is in connection with the press-on portion 15.

It is noted that the locking element 12, or, thus, the strip, as such can be provided with one or more elastic bending zones, which either form a connection between the actual press-on portion 15 and the lock-up body 14, or a connection between several portions of the press-on portion 15, or still between other portions. Such bending zones allow obtaining the desired mutual movability among the composing parts. The embodiment of FIG. 23 is an example thereof, wherein two flexible bending zones 15A are provided, between the attachment lip 54 and the press-on part 15 on the one hand and the press-on part 15 and the lock-up body 14 on the other hand.

Preferably, such bending zones 15A are formed by coextrusion during the manufacture of the locking element 12.

In general, it is preferred that a locking element according to the invention provides for a stable support in vertical direction, whereas in horizontal direction, thus, in the pivoting direction, a flexible movability is effected. The application of co-extruded parts assists therein.

In the case of rectangular floor panels, either oblong or square, it is clear that coupling parts can also be provided at the second pair of opposite sides, which coupling parts, in coupled condition, preferably also offer a horizontal as well as a vertical locking. These coupling parts at the second pair of sides also can be performed as a "push-lock" coupling, whether or not in accordance with the present invention. Preferably, however, at the second pair of sides coupling means will be applied allowing a mutual coupling by means of a pivoting movement between two floor panels to be coupled and/or by means of a shifting movement resulting in a snap-on connection. Such coupling parts are widely known from the state of the art and are described, for example, in WO 97/47834.

Figure 25:
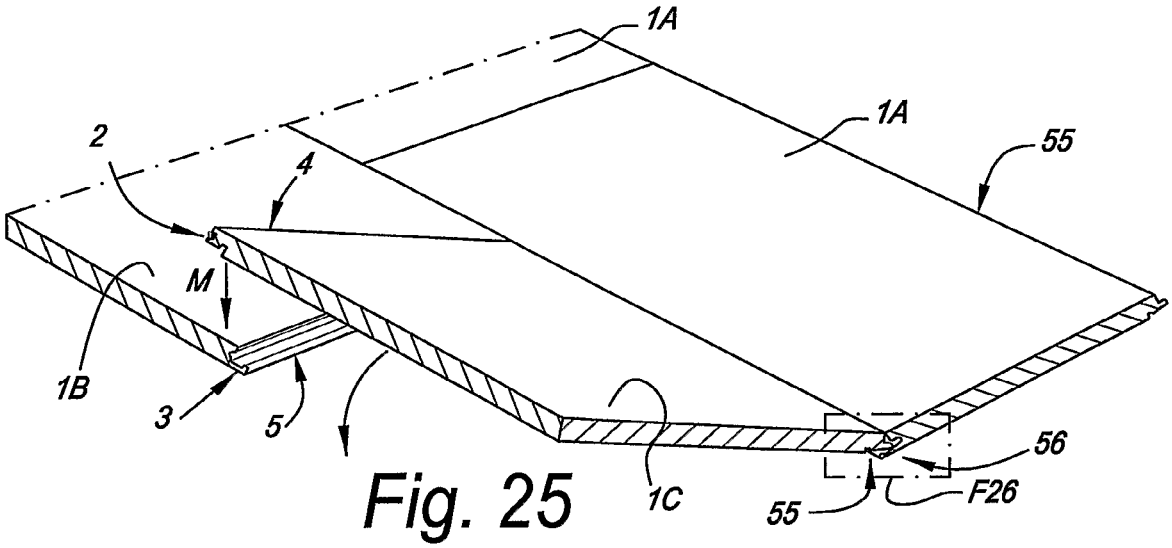
FIG. 25 represents a number of floor panels which are realized according to the invention.
Figure 26:
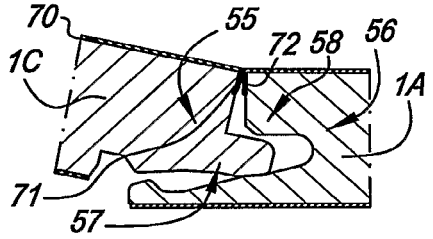
FIG. 26, at a larger scale, represents the portion indicated by F26 in FIG. 25.

In the most preferred embodiment, at the second pair of sides 55-56 coupling parts 57-58 will be applied allowing at least a connection by means of a pivoting movement, as this allows installing the floor panels, as illustrated in FIGS. 25 and 26, in a simple manner. A new floor panel 1C to be installed then can be simply angled at its side 55 into the preceding row of floor panels 1A, and such just next to a preceding floor panel 1B in the same row. When being angled down, the male part of the new floor panel 1C to be installed then automatically engages in the female part of the preceding floor panel 1B, without the necessity of performing another operation. In the case of oblong floor panels 1, thus, it is preferred that the so-called "push-lock" connection then is situated at the short sides.

Figure 27:
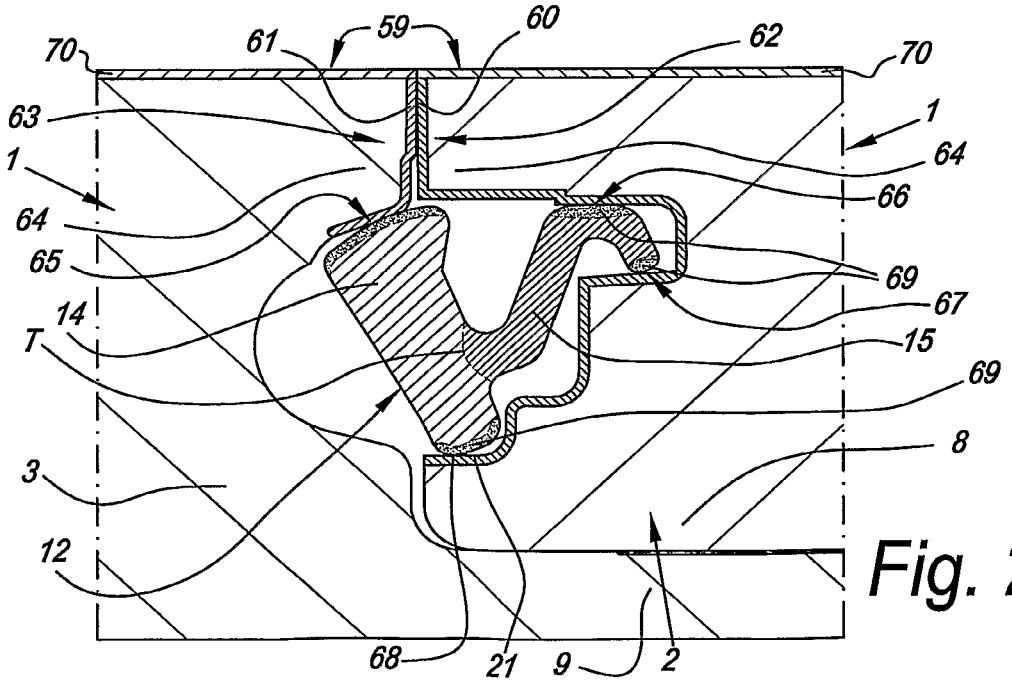

FIG. 27 represents an example of the seventh aspect of the invention. According to this aspect, the locking element 12 consists of a synthetic material strip provided in a recess 13, which strip, in the coupled condition of two floor panels 1, comes into contact with both floor panels 1 and thereby forms a seal, wherein between the upper side 59 of the floor panel 1 and the synthetic material strip also a seal 60-61 is present at the panel edges 62-63. The intention herein is that the synthetic material strip is applied as a seal against the infiltration of water and thereby offers at least a barrier which at least decelerates and preferably completely blocks the possible infiltration of water in between the coupling parts 4-5, whereas the seal 60, 61, respectively, at the panel edges is intended for protecting the panel material 64, which mostly is based on wood, as such against the penetration of water. Possible water which might infiltrate in between two floor panels 1 then can not or only with difficulty infiltrate up to beneath the floor panels 1, whereby the risk of rotting and mould formation beneath the floor panels 1 is restricted, whereas this water also can not penetrate into the floor panels 1 themselves and thus a damage at the floor panels 1 themselves, for example, by swelling, is excluded. The moisture present above the synthetic material strip can evaporate in due course.

In the represented example, the seal against moisture penetration is formed at one side 3 by the contact 65 and at the other side 2 by one or more of the contacts 66, 67 or 68. In order to guarantee a better sealing, the locking element can be provided with one or more sealing material portions 69, for example, of a relatively soft synthetic material or rubber, which are present at the location of the contacts 65-66-67-68 at the locking element 12. These sealing material portions can be provided at the synthetic material strip in any manner. In a practical embodiment, this will be performed by means of coextrusion.

The seals 60-61 at the panel edges 62-63 may have any form. As represented, they are formed, for example, by an impregnation layer or a covering layer, such as a lacquer or varnish layer. They extend from at the top layer downward, each time at least up to one of the locations where said contacts are realized. According to a not represented variant, such seal also may consist in that the top layer extends up to a location where one of the contacts is realized, for example, by applying a top layer which extends over the upper edges downward.

According to the seventh aspect, it is intended that the top layer also is waterproof. Moreover, it then may consist of any material, such as a laminate, a film, a lacquer layer, a water-repellent or waterproof print, a varnish or the like.

It is clear that in this manner both the infiltration of water as well as the penetration of water into the panel edges is avoided.

It is noted that floor panels which are installed in rows, and then in particular oblong floor panels, show the feature that the floor panels will align in the longitudinal direction of the rows and mostly will adjoin well with their sides against each other, whereas at the sides directed perpendicularly to the rows then openings will occur more easily, due to the fact that such floor panels, as a result of production tolerances, often do not have perfectly perpendicularly aligned sides. At the location of such openings, a fast infiltration is possible, and a sealing by means of somewhat elastic coatings on the upper edges of the floor panels mostly is not effective, as the openings are too large to be bridged thereby. Thus, in particular at the location of these sides a sealing principle according to the seventh aspect of the invention will show its benefits. In view of the fact that the sides 55-56 of the floor panels, which are intended to extend in the longitudinal direction of the rows, due to the automatic alignment, adjoin to each other rather well, the problem of infiltration at these sides is little or not at all present and, if one wishes to provide a sealing at all four sides, it may suffice that at these sides exclusively a coating or impregnation is provided on the panel edges, as indicated by reference numbers 71-72 in FIG. 26.

When, as in FIG. 27, use is made of a press-on portion 15 which is clamped, and which is formed by co-extrusion, then it is preferred that the transition T is situated closer to the lock-up body 15 than in the embodiment of FIG. 6. With suitable dimensions in free condition, it may then be obtained that in the mounted condition a force is generated holding the locking element 12 in permanent contact with the support surface 21.

Figure 28:
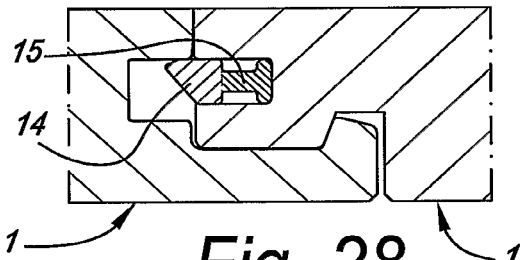
FIGS. 27 and 28 in cross-section represent another two particular embodiments of the invention.

FIG. 28 represents a variant, which makes clear that the inventive idea of the use of a co-extruded locking element 12 in a so-called "push-lock" system is not restricted to embodiments with a pivotable lock-up body. According to FIG. 28, the lock-up body 14 is displaceable and consists of a relatively hard synthetic material, whereas the press-on portion 15 consists of flexible and elastic synthetic material. Herein, the co-extruded press-on portion 15 functions as an elastic mass situated behind the lock-up body 14 in a spring-like fashion.

Figure 29:
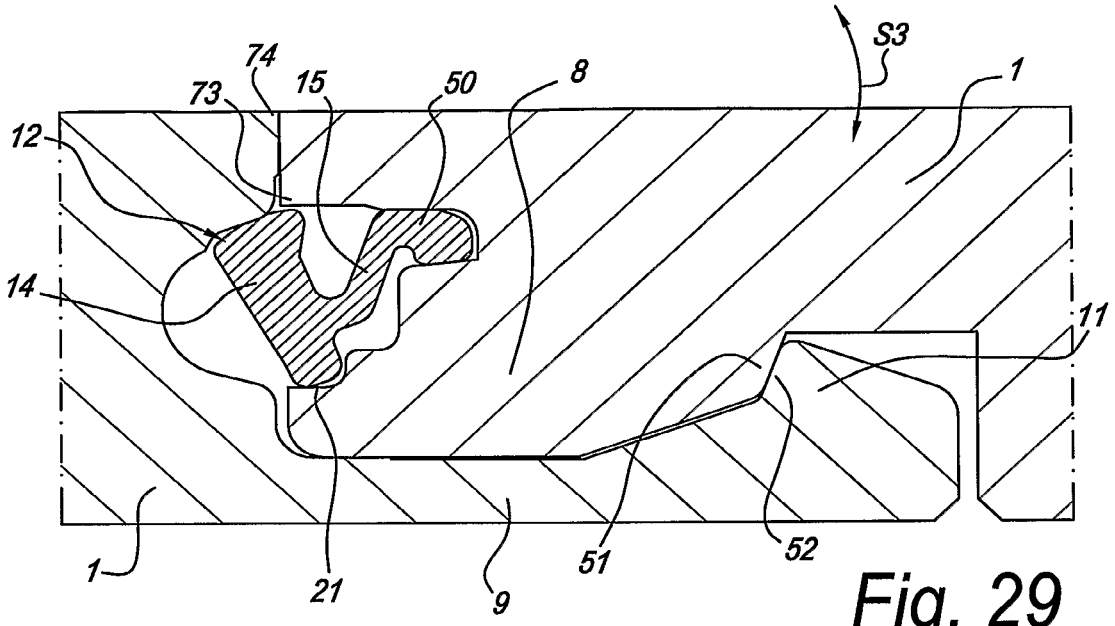
FIGS. 29 and 30 represent another two embodiments of the invention.

FIG. 29 represents another variant, which is comparable to that of FIG. 17. Herein, the difference consists in that the hook-shaped part 11 of FIG. 29 is realized considerably higher than in the embodiment of FIG. 17, such that the contact surfaces 51-52 at least partially are situated higher than the support surface 21 of the lock-up body.

Figure 31:
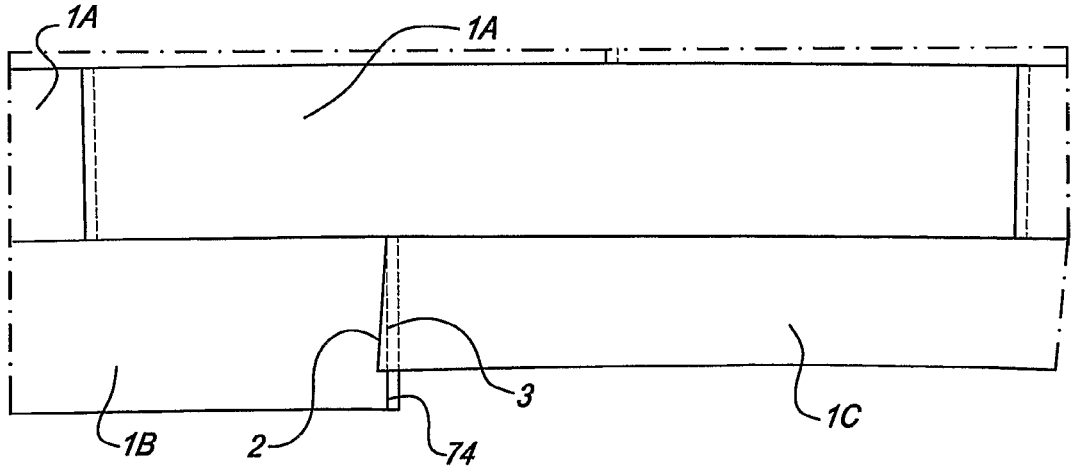
FIG. 31 represents a schematic top view of floor panels, which are coupled to each other according to FIG. 25.
Figure 30:
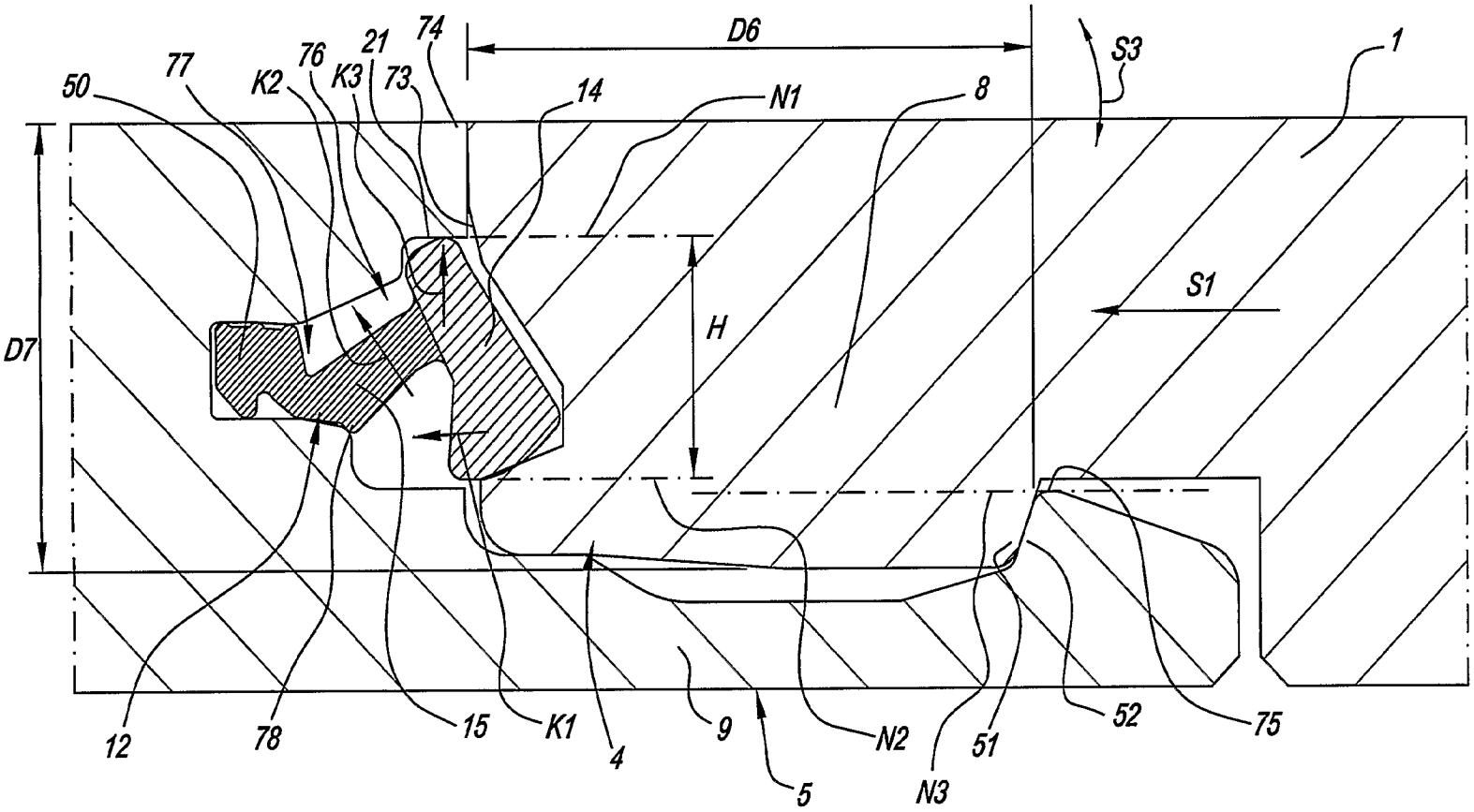

FIG. 30 represents a preferred variant of an embodiment according to the invention, wherein the locking element 12 is provided in the proximal side of the female part. In respect to the embodiment of FIG. 29, this offers an important advantage. In FIG. 29, the edge 73 is made relatively sharp and straight in order to obtain that the lock-up body 14 in free condition still is seated beneath the edge 73. When, during lowering of a floor panel 1 in a manner as depicted in FIG. 25, the sides 2-3 to be coupled to each other do not perfectly correspond, for example, because the floor panels 1B-1C, seen in top view, are overlapping somewhat, for example, as a result of the warping of floor panels in the preceding row, or as a result of un-squareness of the panels, a condition is created as depicted in FIG. 31, wherein then the edge 73 scrapes along the upper edge 74. In the embodiment of FIG. 30, this can easily be counteracted in that the edge 73 can be performed with an adequate chamfer, as a consequence of which a possible contact between edge 73 and upper edge 74 rather results in a sliding movement along each other than in a scraping effect.

Also, in an embodiment according to FIG. 29, the locking element 12, when the right-hand floor panel is moved downward, comes into contact with the sharp upper edge 74 of the left-hand floor panel, whereby also a scraping effect may be created, which can impede the installation. In contrast, the embodiment of FIG. 30 does not show this disadvantage, in view of the fact that the rounded underside of the male part then will slide smoothly along the locking element.

FIG. 30 also relates to an embodiment meeting the eighth aspect of the invention mentioned in the introduction, more specifically in that the edges of the floor panels 1 can be joined into each other by a shifting movement S1.

Moreover, the embodiment of FIG. 30 shows the following characteristics:

the coupling parts 4-5 concerned are realized such at the aforementioned sides, that they allow a locking and/or unlocking of two of such floor panels in mutual respect by mutually angling them into each other, out of each other, respectively;

in free condition, the lip-shaped lock-up body 14 protrudes outward in an inclined manner;

the lock-up body 14 is provided in the proximal side of the female part 9;

the female part 9 and the male part 8 comprise contact surfaces 52-51 at their distal extremities, said surfaces being performed upwardly inclined in distal direction;

the lip-shaped lock-up body 14 is a pivotable body.

In FIG. 30, it is also represented that the lock-up body 14, and still better the entire locking element 12 realized as an insert, is made relatively local, by which in particular is meant that it is only present between a first and a second horizontal level, the first horizontal level N1 of which is situated at a distance beneath the upper side of the coupled floor panels, whereas the second horizontal level N2 is situated lower than the first, however, higher than the lowermost point of the male part. Further, FIG. 3 also shows that said lock-up body 14 extends over a height H which is at least 40% and still better at least 50% of the height difference between the upper side of such coupled floor panels and the lowermost point of the male part, i.e., D7. It is clear that these characteristics are not limited to the embodiment of FIG. 30.

In the case of a pivotable embodiment, wherein one floor panel can be angled into the other or out of it, it is preferred that, as indicated in FIG. 30, the horizontal distance D6, as measured from the upper edges of the floor panels up to the cooperating point of the contact surfaces 51-52, which is situated farthest away from these upper edges, is at least 1.3 times the distance D7 between the upper side of the floor panels and the underside of the male part, which allows a smooth angling movement.

In order to allow a smooth angling in and out and/or shifting together, the highest point 75 preferably is situated at a level N3, which is lower than the lowermost point of the lock-up body 14.

FIG. 30 represents a particular construction of a press-on portion 15, wherein it is clear that this construction also can be applied in other embodiments of floor panels according to the invention. This press-on portion, more particularly the construction thereof, shows the following characteristics:

that the press-on portion 15, viewed in cross-section, is realized as a pivot arm, which is supported or held next to one extremity and adjoins at the other extremity, by means of a hinge and/or bending zone 76, to the rear side of the lock-up body 14;

that said pivot arm has a hinge and/or bending zone 76-77, respectively, at both extremities, in this case formed by thinner parts in the material; moreover, the zone 77 preferably is situated such in respect to an underlying support surface that an upward-directed pivoting movement is possible in a smoother manner than a downward-directed one;

that the press-on portion 15 is realized as a mechanism which, when the lock-up body is compressed, will provide for that this lock-up body becomes positioned with one extremity against a support surface 21; more particularly, a compression K1 results in a pivoting movement K2, as a result of which the lock-up element 14 is pressed upwards according to arrow K3 against the support surface 21;

that the above-mentioned mechanism consists of a pivot arm connecting, one the one hand, to the rear side of the lock-up body and, on the other hand, is supported by means of a support portion, such as a support collar 78.

Finally, it is noted that the floor panels according to the invention in general can be realized such that in coupled condition a so-called "pre-tension" is created, which means that the floor panels at their coupled sides are pressed towards each other by means of a tension force. Herein, the tension force can be supplied in any manner. For example, it may be generated by the elastic bending of the lip bordering the underside of the female part. Herein, the principle can be applied which is known from WO 97/47834, more particularly from FIG. 23 of said WO 97/47834.

It is also clear that floor panels of the present invention can also be equipped with an anti-creak system, more particularly by application of the principle described in WO 2006/032398.

Figure 32:
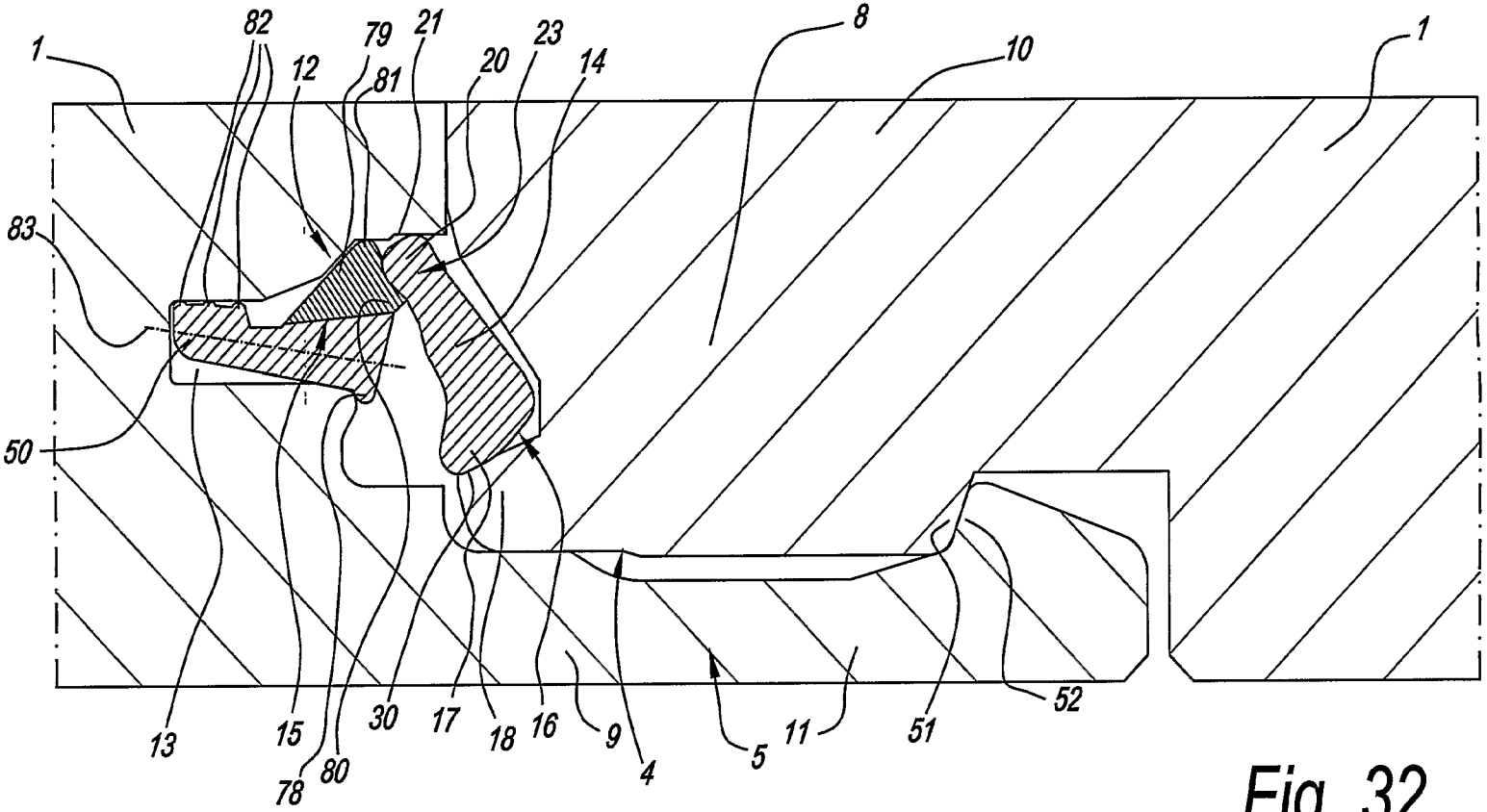
FIG. 32, in cross-section, represents still another embodiment of the invention.

FIG. 32 shows another embodiment meeting the various aspects and in particular the ninth aspect of the invention. Herein, the lock-up body 14 and the attachment portion 50 consist of a relatively rigid material and are connected to each other by coextrusion by means of a material part 79 made as a hinge part, which material part consists of a more flexible and elastic material.

The lock-up body 14 globally forms an angle with the attachment portion 50 and reaches with the extremity functioning as a support portion 20 up to beyond the actual attachment portion 50, in such a manner that at the location 80, where the lock-up body 14 passes along the attachment portion 50, the distance between the lock-up body 14 and the attachment portion 50 is smaller than the distance from the—in this case upwardly protruding—extremity of the lock-up body 14 to the attachment portion 50.

The material part 79 is situated between the actual attachment portion 50 and said protruding beyond it extremity of the lock-up body 14. This design has the advantage that the lock-up body 14, due to the small material quantity at the location 80, can hardly be displaced in respect to the attachment portion 50, with the exception of an angling movement, whereas in upward direction sufficient flexible material of the material part 79 is present in order to hold the lock-up body 14 in a certain position and to allow the desired elastic movement thereof. Still another advantage is that, when the lock-up body 14 is angled in, the material on the location 80 is compressed and the lock-up body 14 also is pushed upward, as a consequence of which it remains in contact with the support surface 21.

In mounted condition, the locking element 12 preferably is supported at least on three locations, on the one hand, at the bottom at the height of the support collar 78, at the top by the upper side 81 of the material part 79, as well as at the height of the represented ribs 82.

FIG. 32 also shows that the attachment portion 50 is provided substantially flat in the recess 13, in other words, that the direction 83 in which this attachment portion 50 extends, deviates little or not at all from the plane of the floor panels. By altering this direction 83, which a manufacturer of floor panels can do in a simple manner by positioning the recess 13 somewhat differently, different functioning characteristics in respect to angling the lock-up body in and out can be obtained, such that an optimization is possible.

FIGS. 33 to 37 represent another variant of the invention. A number of differences in respect to the embodiment of FIG. 32 will be discussed in the following.

A first difference consists in that the locking element 12 in vertical direction is supported in the recess 13 by means of only three support portions, or at least substantially by only three support portions, one support portion of which is formed by the aforementioned support portion 20 of the lock-up body 14. The other two support portions, 84 and 85, respectively, preferably are situated at the upper side and underside of the actual attachment portion 50. More particularly, it is preferred that the support portion 84 situated at the top is located in respect to the floor panel more proximally than the support portion 85 situated at the bottom. Still more particularly, it is preferred that the support portion 84 of the upper side is located at the—situated proximally in respect to the floor panel 1—extremity of the actual attachment portion 50, whereas the support portion 85 is located at the distally situated extremity. A considerable difference from the embodiment of FIG. 32 thus is that the material part 79, at least in the free condition, does not form a support point. It is clear that one and the same support portion as such may comprise several contact points, for example, if it should have a ribbed surface.

Figure 33:
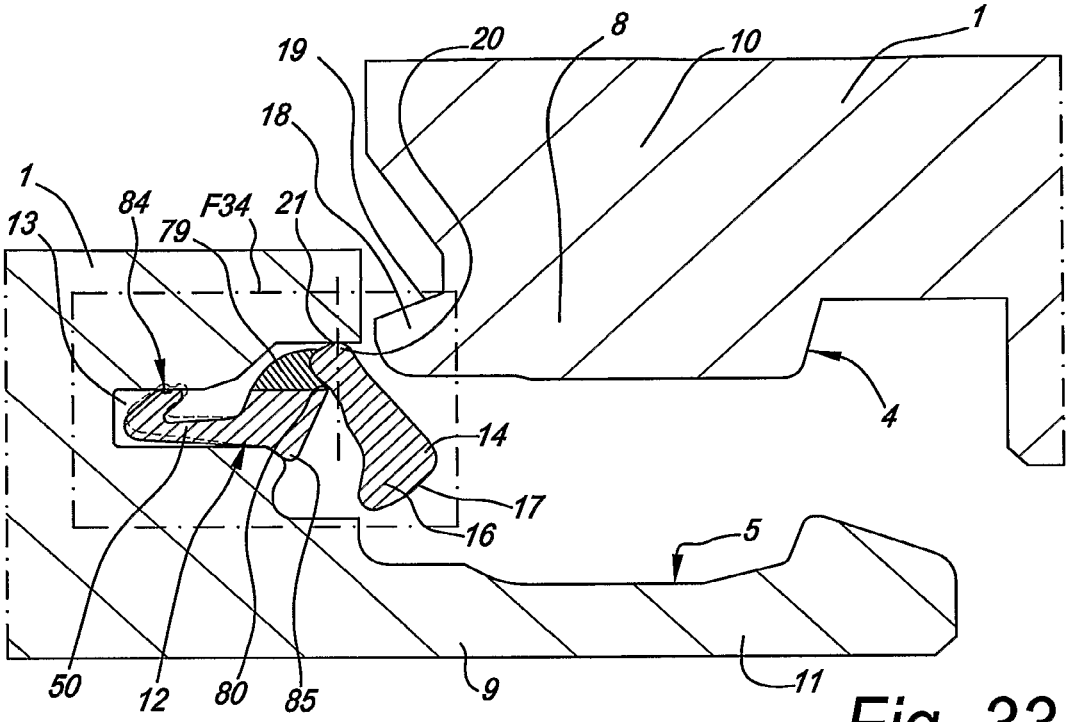
FIG. 33 in cross-section represents still another embodiment of the invention.

In this embodiment, the locking element 12 is configured such that in the mounted, however, not impressed condition, namely the one from FIG. 33, a certain clamping thereof in the recess 13 is created. This is obtained, for example, by the elastic deformation of the actual body of the attachment portion 50 from the position represented in dashed line in FIG. 33 to the position represented in solid line, which deformation is achieved during clamping of the locking element 12 in the recess 13.

A second difference consists in that the actual attachment portion 50 is configured and attached in the recess 13 such, that during joining of two floor panels 1 a certain movability of the actual attachment portion 50 is possible. In the represented example, the support portion 85 to this aim is provided with a guiding surface 86, which can cooperate with an inclined guiding surface 87 at the floor panel, whereby a small displacement 88 of the attachment portion 50 is possible, such as will be described in the following by means of FIGS. 34 to 37.

Figure 34:
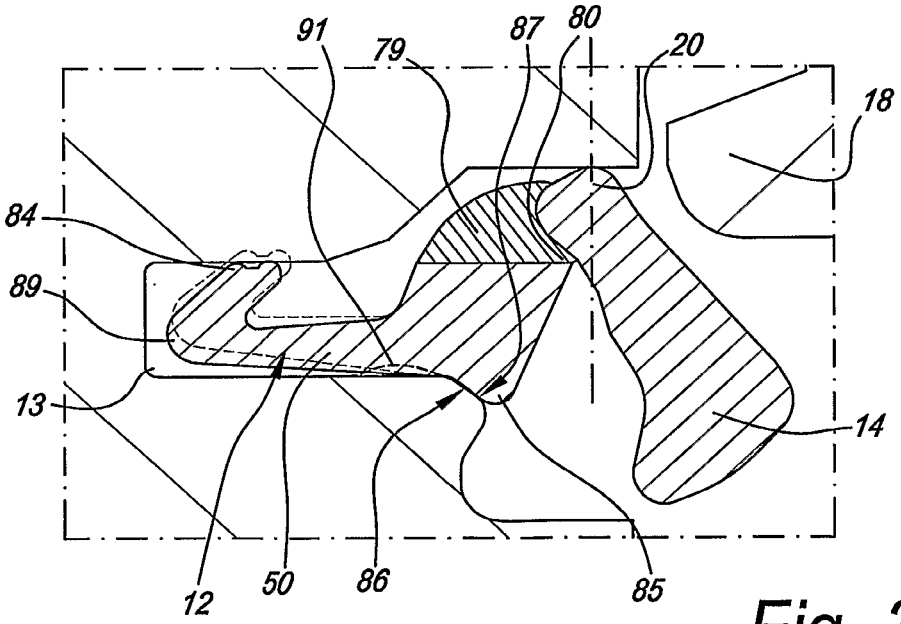
FIG. 34, at a larger scale, represents the portion indicated by F34 in FIG. 33.
Figure 35:
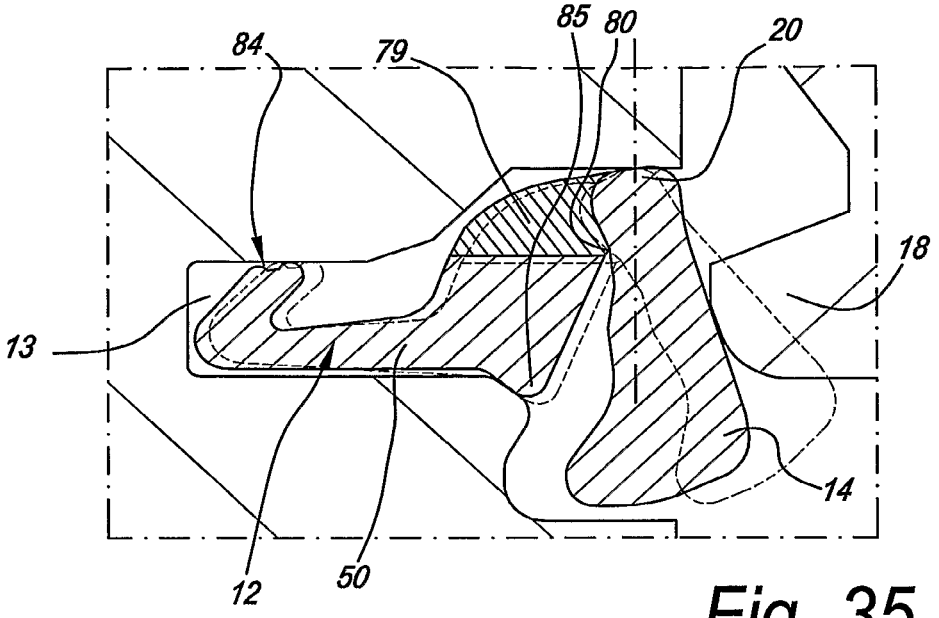
FIGS. 35 to 37 represent the part from FIG. 34 for various conditions during coupling of two floor panels.
Figure 36:
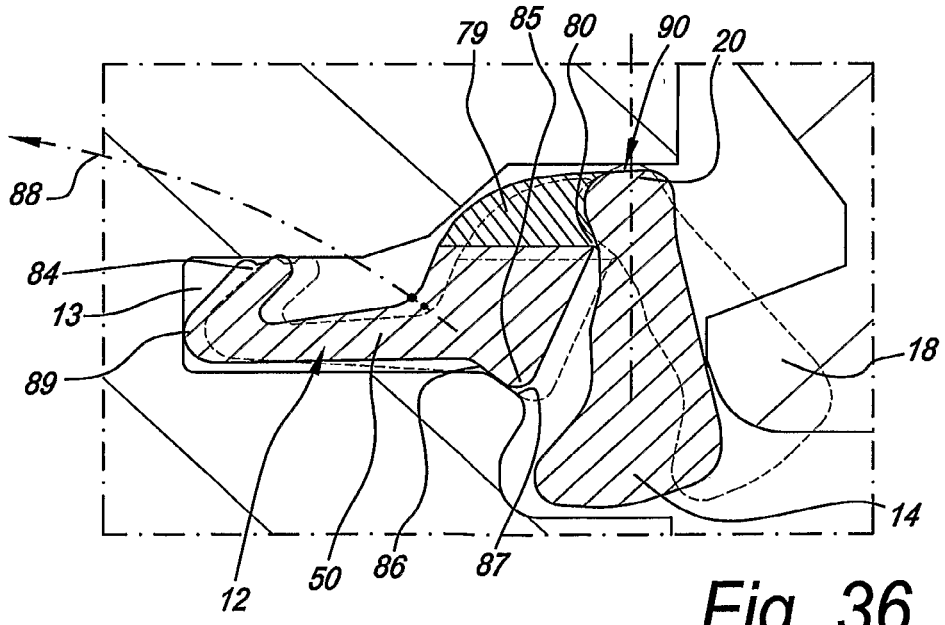
Figure 37:
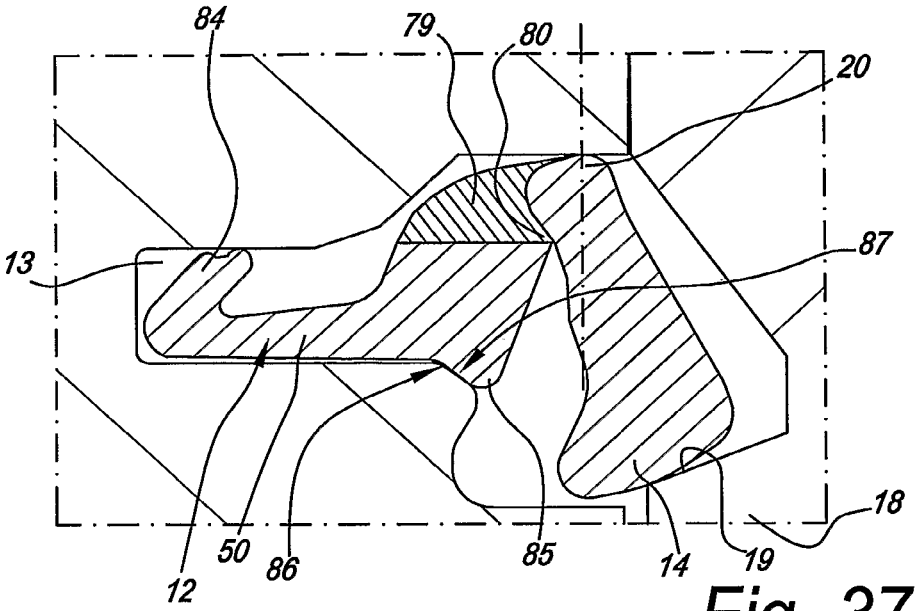

FIGS. 34 to 37 represent successive conditions of the locking element 12 during joining of two floor panels 1. FIG. 34 shows the rest position. Due to the tension force in this entity, the support portion 85 has the tendency to slide downward along the guiding surface 8 until it reaches the represented position. FIGS. 35 and 36 represent successive conditions, wherein the right-hand panel is angled down and the lock-up body 14 is pushed aside. Due to the fact that on the location 80 very little material of the material portion 79 is present between the lock-up body 14 and the actual attachment portion 50, this latter, starting from a certain moment, is also forced somewhat inward, wherein it moves with its guiding surface 86 along the guiding surface 87, until it reaches a condition, as depicted in FIG. 36. Herein, the attachment portion 50, so to speak, makes room for the movement of the lock-up body 14 and thereby performs a more or less rotating displacement 88, such, for example, until it comes with its extremity 89 into contact with the deepest point of the recess 13. Hereby is obtained, amongst others, that the support portion 20 rotates practically exclusively at its place along its highest point and performs little or no rolling movement along the floor panel. Further, the whole may be designed such that the actual attachment portion 50, after the locking of the floor panels, also more or less arrives back at its initial location, as depicted in FIG. 37. The downward-protruding support portion 85 thus indeed provides for a blocking function, which determines the normal position of the locking element 12 in the recess, however, with a certain load in fact will allow an extra movement 88.

As represented in FIG. 36, the locking element 12 according to the invention may also be configured such that in the most impressed condition, a free space 90 is created between the support portion 20 and the wall of the recess 13. The proper configuration for this purpose can be determined by tests. An advantage thereof is that during the initial backward movement of the lock-up body 14, there is no friction present between the support portion 20 and the wall of the recess 13, which might prevent the smooth pivoting outward of the lock-up body 14.

As is represented in FIG. 34 by dashed line 91, according to a variant a deformation may be provided in the wall of the recess 13, which deformation cooperates with a deformation in the attachment portion 50, as a result of which the locking element 12, so to speak, can be fixedly attached in the recess 13 by means of a snap-on connection.

It is clear that the essential characteristics of the embodiments of the FIGS. 32 and 33-37 consist in that the locking element 12, viewed in cross-section, consists at least of an actual attachment portion 50, a lock-up body 14, which can perform at least an angling movement, and a material part 79, which is present between the attachment portion 50 and the lock-up body 14, which material part consists of a material which is more flexible and elastic than the material of the lock-up body 14 and which thereby functions at least as a hinge part. From the above, it is clear that all other characteristics described by means of FIGS. 33 to 37 are facultative and that all these facultative characteristics can be mutually combined at random. Herein, the most important preferred characteristic consists in that the attachment portion 50, the material part 79 and the lock-up body 40 by means of coextrusion are realized as a one-piece strip. Herein, it is preferred that the actual attachment portion 50 and the lock-up body 14 are manufactured of one and the same material, whereas the material part 79 consists of a more flexible material. In principle, the same basic substances can be applied for both materials, however, they may differ from each other by the addition of additives, such as plasticizers. The material of the material part 79 preferably behaves like a relatively soft rubber, whereas the material of the actual attachment portion 50 and of the lock-up body 40 preferably behaves like a classic synthetic material, such as common PVC, and thus, in view of the small dimensions in cross-sections, also behaves in a relatively rigid manner.

It is clear that the embodiment according to FIGS. 33 to 37 also allows that two of such floor panels can be brought into each other at the represented edges not only by means of a downward movement, but also by means of an angling movement or by shifting towards each other. Unlocking may take place, for example, by angling the floor panels out of each other. Also, it is not excluded to provide a recess in this embodiment, analogous to the recess 46 in FIGS. 15 and 16, such that unlocking by means of a rod 47 is possible.

In general, it is noted that by the characteristic that "the support portion, for example, 20, is rotatable against a support surface, for example, 21", it is intended that there is a contact at least during part of the rotation and that it thus is not excluded that there is no contact for a part of the rotation, as becomes clear from the example of FIG. 36, wherein in a certain position indeed a free space 90 is present. The contact will normally be present indeed from a certain angling-out of the lock-up body.

The fact that such support portion 20 is rotatable against a support surface 21, must be interpreted in the broadest sense. The rotation can provide for a local rotation of the support portion 20, as well as a rolling movement along the support surface, as well as a combination of both. Also, it is not excluded that the turning movement is combined with shifting. A local rotation, or "pivoting against a support or rotation point", may concern a turning around a point or zone which is, are, respectively, situated in the support surface 21, as well as a rotation point or rotation zone at a distance from the support surface.

In the production of floor panels according to the invention, the recess 13 can be realized in any manner. According to a preferred characteristic, this takes place by means of a milling treatment, which is performed when realizing said female coupling part.

The application of the strip-shaped locking element 12 in the recess 13 may also be performed in any manner. In the following, two non-restrictive embodiments of methods for this purpose are described, which can be applied within the scope of the present invention.

Figure 38:
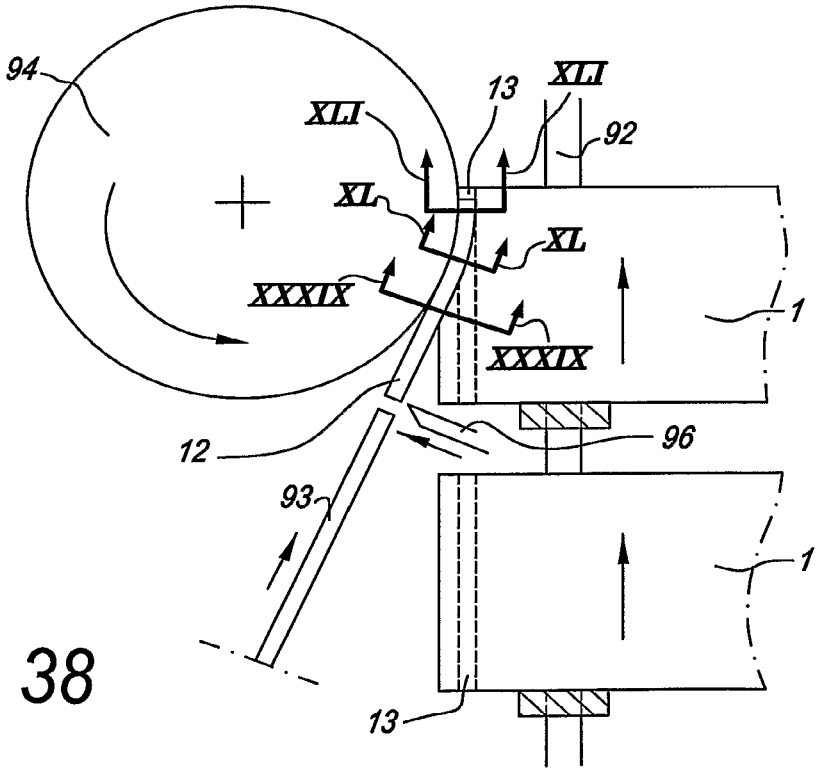
FIG. 38 schematically represents how a locking element, made as an insert, according to the invention can be attached in the edge of a floor panel.
Figure 39:
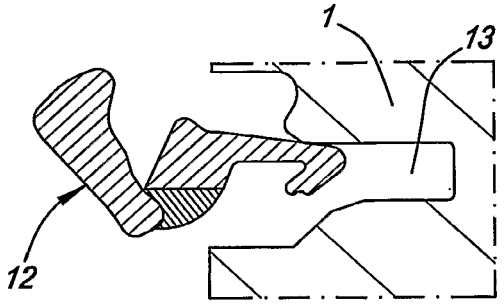
FIGS. 39 to 41, at a larger scale, represent cross-sections according to lines XXXIX-XXXIX, XL-XL and XLI-XLI, respectively, in FIG. 38.
Figure 40:
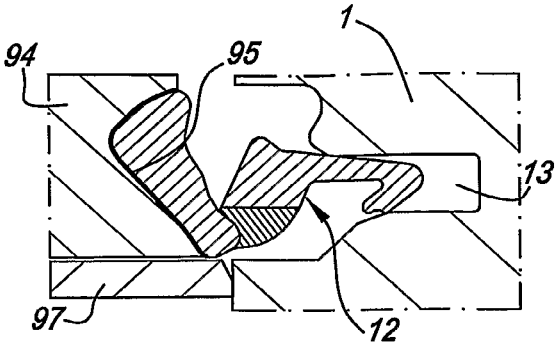
Figure 41:
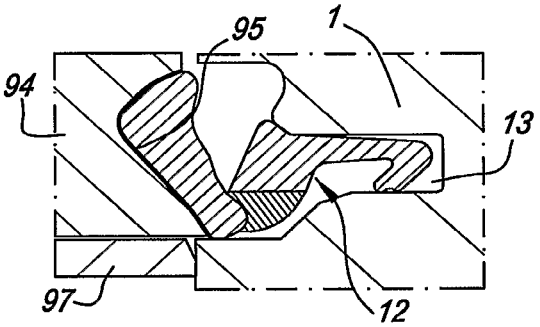

According to a first technique, the strip-shaped locking element 12 systematically is fixedly pressed on in the recess 13, preferably is rolled into it. Preferably, this takes place, as represented in FIG. 38, by displacing the floor panels 1, which mostly are lying upside down, by means of a conveyor 92, supplying thereto a strip 93 from which the strip-shaped locking elements 12 have to be cut off, and fixedly pressing on this strip 93, the locking elements 12 cut off therefrom, respectively, in the recesses 13 of the successive floor panels 1 by means of a locally installed rotating press-on roll 94. FIGS. 39 to 41 show, how the strip is pressed on in the recess 13 by means of the press-on roll 94, which to this aim can be provided with a profiled surface 95.

It is clear that the strip 93 can be supplied from a stock, for example, a wound stock. Further, a cutting device 96 is present for separating the locking elements 12 at a suitable length from the strip 93, which device is illustrated schematically only. It is clear that in practice the necessary guiding elements will be present in order to have the strip 93 and the locking element 12 follow the correct course, of which the guiding element 97 in FIGS. 40 and 41 is an example.

Figure 42:
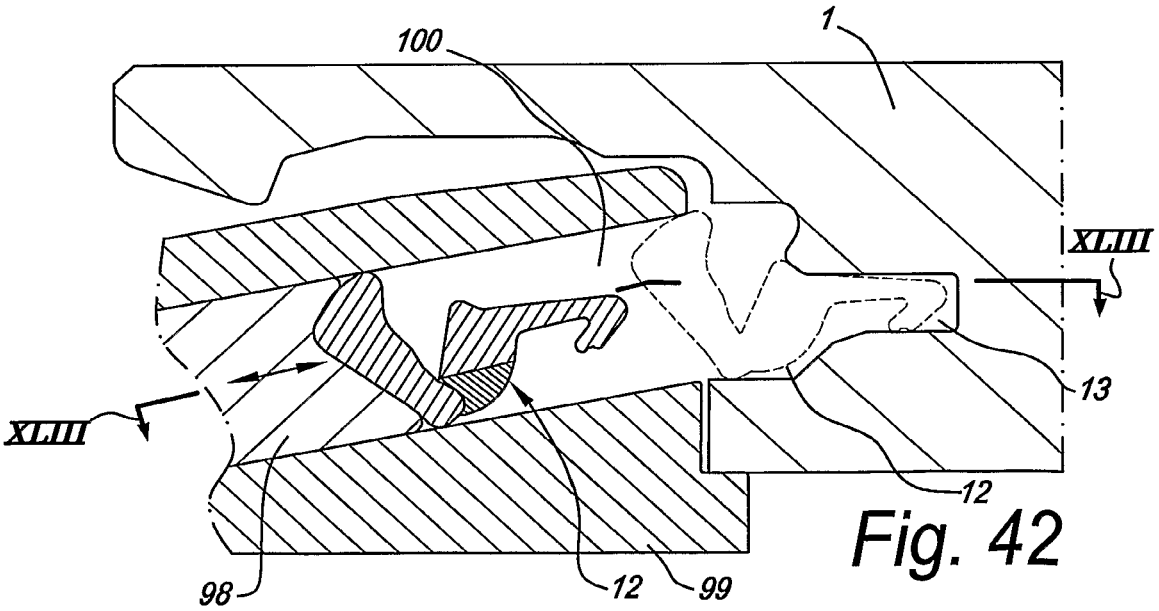
FIG. 42 in cross-section represents still another embodiment of a technique according to the invention, according to which a locking element made as an insert can be attached in the edge of a floor panel.

FIG. 42 shows a variant, wherein according to the invention a method is applied wherein a cut to length strip-shaped locking element 12 over its entire length simultaneously is pressed into the recess 13. As represented in FIG. 42, this preferably is performed by means of a device with a slider or plunger 98, with which the locking element 12 laterally is pushed over its entire length at one go into the recess 13. As represented, the device preferably comprises a holder 99, in which a space 100 is defined, in which a locking element 12 to be applied can be taken up and wherein the plunger 98 can be shifted. Then, the holder 99, together with the plunger 98 present therein and the locking element 12 present therein, is positioned opposite to the edge of a floor panel concerned, as illustrated in FIG. 42, after which, by displacing the plunger 98 to and fro to the right, the locking element 12 is brought from the position represented in solid line to this position represented in dashed line, after which it remains in the recess 13.

Figure 43:
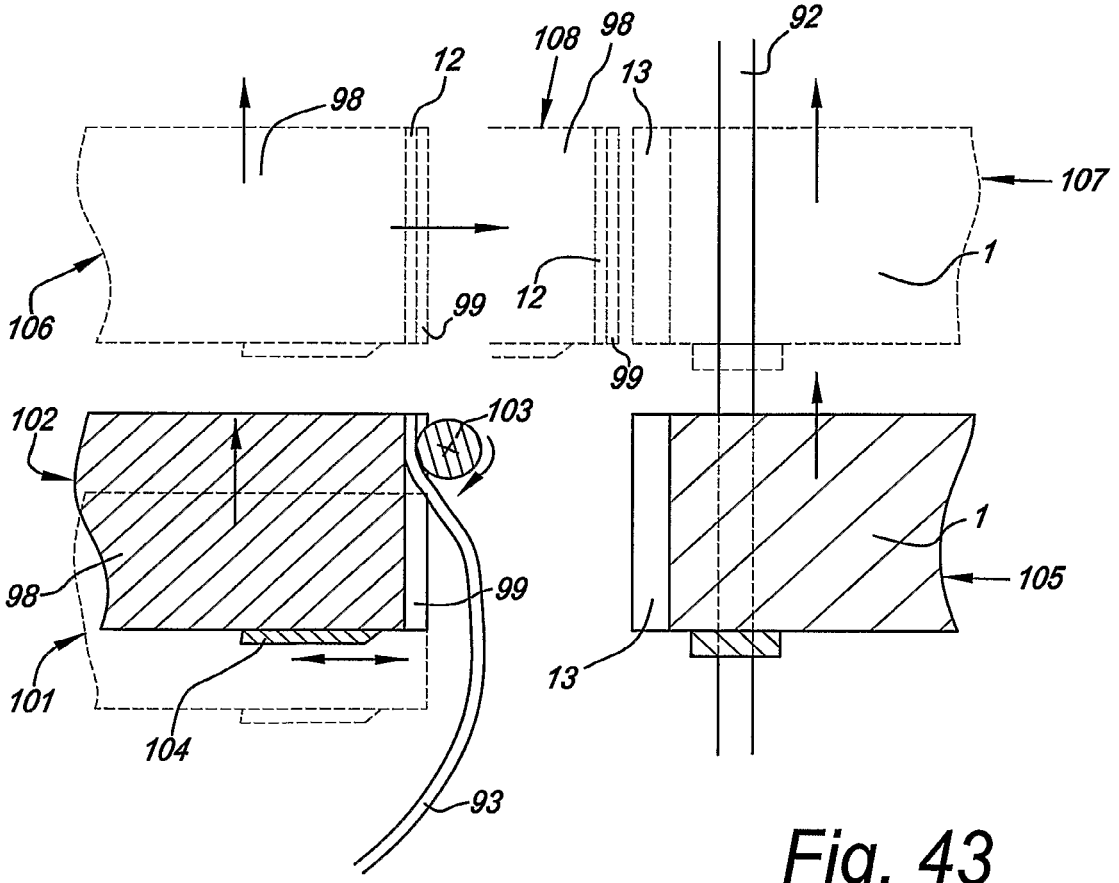
FIG. 43 represents a schematized cross-section according to line XLIII-XLIII in FIG. 42.

FIG. 43 schematically shows how the device from FIG. 42 can be applied in practice. In this example, the floor panels 1 are displaced along a conveyor 92. The holder 99, too, can perform various displacements, as will become clear from the function sequence described in the following.

Initially, the holder 99 is situated in a position 101. First, a strip 93 is supplied to the holder, which strip is provided in the space 100. As represented, this may be realized, for example, by displacing the holder 99 along a press-on roll 103 with which the strip 93, which is supplied from a not represented stock, is directed into the space 100 of the holder 99, as illustrated for the position 102 of the holder 99. The length necessary for forming the locking element 12 is then cut off by means of the schematically represented cutting device 104. In the meantime, a floor panel has arrived in a position 105. Subsequently, the holder 99 can follow the movement of a passing floor panel 1, as a result of which they come into positions 106 and 107, respectively. During this movement, the holder 99 and the floor panel concerned can be presented to each other, for example, by laterally displacing the holder 99 until it reaches position 108. Hereby then the condition of FIG. 42 is obtained, after which it suffices to activate the plunger 98 in order to bring the locking element 12 into the recess 13. As described above, all this can take place during the continuous conveyance of the floor panels, for example, after they exit the milling device and before they are packaged. The holder 99, or possibly several applied holders 99, then can be displaced to and fro through all abovementioned positions. Also, multiple holders on a conveyor belt might be used, wherein a holder then is brought from position 108 back to position 101, while already one or more other holders pass through the same trajectory. According to a variant, panels also may be supplied stepwise instead of continuously to an insertion device for locking elements 12.

It is clear that by a lock-up body 14 which can be pivoted or bent out, it is intended that it can be pivoted or can be bent out in the plane of a cross-section.

Generally, it is noted that the support portion of the lock-up body, around which it is rotatable, is a support portion which is intended to take up the forces when the floor panels attempt to get away from each other in upward direction. From US2007/0006543, which corresponds to WO2007/008139, also a rotatable locking element is known, which, however, contrary to the invention, does not rotate around a support point which, as above, is intended to provide for a lock-up support function which counteracts the unlocking of the floor panels.

By a "rigid" lock-up body, it is meant that this rigidity exists at least in a plane according to the cross-section.

The present invention is in no way limited to the embodiments described by way of example and represented in the figures, on the contrary may such floor panels be realized in various forms and dimensions, without leaving the scope of the invention.

From the above, it is clear that the invention, and in particular the locking element according to the invention, can be employed in various floor panels, amongst others, in laminate floor panels, prefabricated floor panels, such as so-called "engineered wood", solid parquet, veneer parquet, as well as floor panels which are provided with any top layer, for example, vinyl, linoleum, stone, metal and the like.

It is noted that the core of such floor panel not necessary has to consist of wood or a product on the basis of wood and in principle may consist of any material, thus, for example, also synthetic material.

The invention claimed is:

1. A floor panel, wherein the floor panel comprises, at least at two opposite sides, coupling parts with which two of such floor panels can be coupled to each other; wherein the coupling parts form a horizontally active locking system and a vertically active locking system; wherein the horizontally active locking system has a male part and a female part, which allow to connect two of such floor panels to each other by providing one of these floor panels with the pertaining male part, by means of a downward movement, in the female part of the other floor panel, the male and the female part being substantially made from the actual panel material; wherein the vertically active locking system comprises a locking element, which is provided in the form of an insert in one of the sides; wherein the locking element comprises a lock-up body, said lock-up body forming a stop-forming locking portion which can cooperate with a locking portion of a similar coupled floor panel; wherein the locking element consists of a synthetic material strip provided in a recess, which strip, in a coupled condition of two floor panels, comes into contact with both floor panels and forms a seal, wherein between an upper side of the floor panel and the synthetic material strip also a seal is present at panel edges located downward and generally perpendicularly relative to the upper side of the floor panel; wherein the floor panel comprises a top layer;

wherein the seals at the panel edges are provided by an impregnation layer or a covering layer, wherein the impregnation layer or the covering layer extends downward from the top layer over the panel edges and contacts the locking element over at least one location in a coupled condition of two of such floor panels as part of the vertically active locking system.

2. The floor panel of claim 1, wherein, in a coupled condition of two of such floor panels, the floor panels at the mutually coupled sides are pressed towards each other by means of a tension force;

wherein the male part is formed by a downward-directed extremity of a hook-shaped part;

wherein the female part includes a seat formed by means of an upward-directed hook-shaped part;

wherein the upward-directed hook-shaped part comprises an elastically bendable lip bordering an underside of the female part, wherein the tension force is generated by the lip being bent out elastically downward in the coupled condition, and being arranged to bounce back to press against the male part, so as to press the panels at their coupled sides towards each other.

3. The floor panel of claim 1, wherein the floor panel is rectangular, either oblong or square;

wherein coupling parts are also provided at a second pair of opposite sides, which, in coupled condition, also offer a horizontal as well as a vertical locking;

wherein at the second pair of opposite sides the coupling parts allow a mutual coupling by means of a pivoting movement, such that the floor panel can be angled in at one of its sides of the second pair into a preceding row of floor panels and such just next to a preceding floor panel in the same row and, when being angled down, the male part of the floor panel then automatically engages in the female part of the preceding floor panel.

4. The floor of claim 3, wherein the edges at the second pair of opposite sides are provided with a coating or impregnation.

5. The floor of claim 1, wherein the floor panel comprises a top layer, wherein the top layer consists of a laminate, a film, a lacquer layer, a water-repellent or waterproof print, or a varnish.

6. The floor panel of claim 1, wherein the seal against moisture penetration is formed at one side by the at least one contact and at the other side by the at least one contact.

7. The floor panel of claim 6, wherein the locking element is provided with one or more sealing material portions of a relatively soft synthetic material or rubber, which are present at the location of the at least one contact at the locking element.

8. The floor panel of claim 1, wherein the floor panel comprises one or more than one of the following features:

the panel is mostly based on wood;

the floor panel is a laminate floor panel, wherein the floor panel comprises a core in Medium Density Fiberboard (MDF) or a core in High Density Fiberboard (HDF);

the floor panel is an engineered wood floor panel;

the floor panel is a solid parquet;

the floor panel is a veneer parquet;

the core of the floor panel consists of synthetic material.

9. The floor panel of claim 1, wherein the locking element comprises at least a pivotable lock-up body; wherein the lock-up body at one extremity forms a stop-forming locking portion, which can cooperate with a locking portion of a similar coupled floor panel.

10. The floor panel of claim 9, wherein the floor panel comprises one or a combination of two, three, four or all five of the following features:

the pivotable lock-up body, opposite from the extremity forming the locking portion, comprises a support portion, which is rotatable against a support surface pertaining to the floor panel concerned, and more particularly in a seat;

the pivotable lock-up body, opposite from the extremity forming the locking portion, comprises a support portion and the lock-up body, between the locking portion and the support portion, in itself is free from hinge portions and bending sections;

the pivotable lock-up body, opposite from the extremity forming the locking portion, comprises a support portion in the form of a free extremity, which, at least in a vertical direction, is positively supported by a support portion pertaining to the floor panel;

the lock-up body is rotatable around a rotation point, support point, respectively, and the locking element comprises a press-on portion, which engages at a distance from the rotation point, support point, respectively, on the lock-up body;

the vertically active locking system comprises a tensioning system, which is formed by a cam surface formed at the extremity of the locking portion of the lock-up body, which cam surface, in coupled condition, provides a wedge effect against the opposite locking portion of the coupled floor panel.

11. The floor panel of claim 9, wherein the pivotable lock-up body, next to the extremity along which it is rotatable, comprises a tensioning system; wherein the tensioning system consists of a cam realized at said extremity, the cam, when the lock-up body is rotated outward, also subjects this lock-up body to an axial displacement in a direction of the locking portion.

12. The floor panel of claim 1, wherein the locking element is a co-extruded locking element, wherein the locking element comprises a lock-up body and a co-extruded press-on portion, wherein the lock-up body is displaceable and wherein the co-extruded press-on portion is provided for functioning as an elastic mass situated behind the lock-up body in a spring-like fashion.

13. The floor panel of claim 1, wherein the locking element consists of a co-extruded synthetic material strip with, viewed in cross-section, zones of synthetic material with different features, more particularly different flexibility.

14. The floor panel of claim 1, wherein the locking element is situated in a distal side of the male part.

15. The floor panel of claim 1, wherein the locking element is situated in a proximal side of the female part.

16. The floor panel of claim 1, wherein the lock-up body is lip-shaped.

* * * * *